US006605404B2

(12) United States Patent
VanDusen et al.

(10) Patent No.: US 6,605,404 B2
(45) Date of Patent: Aug. 12, 2003

(54) COATED CARRIERS

(75) Inventors: John G. VanDusen, Sunset Beach, NC (US); Thomas R. Hoffend, Webster, NY (US); K. Derek Henderson, Rochester, NY (US); Chieh-Min Cheng, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/965,469

(22) Filed: Sep. 28, 2001

(65) Prior Publication Data

US 2003/0064314 A1 Apr. 3, 2003

(51) Int. Cl.[7] ..... G03G 9/113
(52) U.S. Cl. ..... 430/111.1; 430/111.35; 430/137.13
(58) Field of Search ..... 430/137.13, 111.1, 430/111.35

(56) References Cited

U.S. PATENT DOCUMENTS 3,500,900 A * 3/1970 Kupka et al. ..... 165/47
3,590,000 A 6/1971 Palermiti et al. ..... 252/62.1
5,278,020 A * 1/1994 Grushkin et al. ..... 430/137
5,290,654 A * 3/1994 Sacripante et al. ..... 430/137
5,308,734 A * 5/1994 Sacripante et al. ..... 430/137
5,344,738 A * 9/1994 Kmiecik-Lawrynowicz et al. ..... 430/137
5,370,963 A * 12/1994 Patel et al. ..... 430/137
5,403,693 A * 4/1995 Patel et al. ..... 430/137
5,501,935 A * 3/1996 Patel et al. ..... 430/137
5,935,750 A * 8/1999 Barbetta et al. ..... 430/106.6
5,945,244 A * 8/1999 Barbetta et al. ..... 430/106.6
6,004,712 A * 12/1999 Barbetta et al. ..... 430/108
6,010,812 A * 1/2000 Barbetta et al. ..... 430/106.6
6,042,981 A * 3/2000 Barbetta et al. ..... 430/106.6
6,251,554 B1 * 6/2001 Hoffend et al. ..... 430/106.2

* cited by examiner

*Primary Examiner*—John Goodrow
(74) *Attorney, Agent, or Firm*—E. O. Palazzo

(57) ABSTRACT

A process which comprises mixing a carrier core with a polymer core and polymer shell and wherein the polymer shell is present as a coating on said core and said polymer core, wherein said polymer core is generated by emulsification of and heating of monomer forming a seed latex; adding a portion of said seed latex to said emulsification mixture, followed by heating and adding another second portion of said seed latex; and wherein said shell is generated by emulsion polymerization of a monomer, followed by heating.

32 Claims, No Drawings

COATED CARRIERS

CROSS REFERENCES

Illustrated in U.S. Pat. No. 6,004,712, the disclosure of which is totally incorporated herein by reference, is, for example, a carrier comprised of a core and thereover a polymer of (1) methylmethacrylate and a monoalkyl aminoalkyl methacrylate, or (2) a polymer of methylmethacrylate and dialkylaminoalkyl methacrylate.

Illustrated in U.S. Pat. Nos. 5,945,244; 6,042,981; 6,010,812; and 5,935,750, the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in U.S. Pat. No. 5,945,244, the disclosure of which is totally incorporated herein by reference, a carrier comprised of a core, and thereover a polymer of styrene, an olefin and a dialkylaminoalkyl methacrylate; in U.S. Pat. No. 6,042,981, the disclosure of which is totally incorporated herein by reference, is illustrated a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkylaminoethyl methacrylate, or (4) polystyrene/alkyl acrylate/alkyl hydrogen aminoethyl methacrylate; U.S. Pat. No. 6,010,812, the disclosure of which is totally incorporated herein by reference, is illustrated a carrier comprised of a core and a polymer coating of (1) styrene/monoalkylaminoalkyl methacrylate or (2) styrene/dialkyl aminoalkyl methacrylate; and in U.S. Pat. No. 5,935,750, the disclosure of which is totally incorporated herein by reference, is illustrated a carrier comprised of a core and a polymer coating containing a quaternary ammonium salt functionality.

The appropriate components and processes of the above recited patents may be selected for the present invention in embodiments thereof.

BACKGROUND OF THE INVENTION

The present invention is generally directed to carriers, and more specifically coated carriers and wherein the coating is generated by latex processes, and yet more specifically, by aggregation and coalescence or fusion of the latexes generated, and which latex is comprised of a core and a shell thereover, that is, for example, a structured latex. The resulting coated carriers can be selected for known electrophotographic imaging and printing processes, including digital color processes, and more specifically for imaging processes, especially xerographic processes, with high toner transfer efficiency, such as those obtained with a compact machine design without a cleaning component, or those that are designed to provide high quality colored images with excellent image resolution, acceptable signal-to-noise ratio, and image uniformity, and for imaging systems wherein excellent carrier triboelectric charging values and carriers with tuneability or preselected triboelectric charge are generated.

Aspects of the present invention relate to coated carrier particles and wherein the coating is comprised of a latex polymer with a core-shell structure, or a core encapsulated within a shell polymer or shell coating, and which structure possesses, for example, excellent fix and excellent gloss characteristics and wherein the structure can be generated by, for example, semicontinuous methods, emulsion polymerization, consecutive emulsion polymerization sequences and the like. The latexes of core and shell which can be prepared by a single stage reaction are more specifically of a unimodal molecular weight distribution and single glass transition temperature. A wide variety of latex polymers of for example, differing homopolymeric and copolymeric composition, such as styrene-butadiene-acrylic acid copolymers, styrene-butyl acrylate-acrylic acid copolymers, acrylic homopolymers and copolymers which possess specific chemical, mechanical and/or triboelectrical properties for toner and carrier applications can be generated. With the core-shell latexes one can select the optimum properties of each of the core and shell resins, or polymers, such as gloss and fix, which otherwise may not readily obtainable by a single latex. Another advantage of the structured latexes is that the gloss and fix levels can be varied, within for example, the limits of individual polymer properties by adjusting the glass transition temperature, molecular weight, or proportions of each polymer of the core and of the shell. Also, when resin A, the carrier core polymer, possesses a low molecular weight of about 5,000 to about 25,000 there could result for the developed image, an image gloss of greater than 50 gloss units, however, the fix may be poor, wherein the MFT is higher than 190° C., or from about 195° C. to about 225° C., while if resin B has a high molecular weight of about 40,000 to about 80,000, there could result a poor gloss of, for example, an image gloss lower than about 50 gloss units, or from about 30 to about 45 gloss units, and wherein the MFT minimum toner fixing temperature is lower than about 180° C., or from about 150° C. to about 175° C. By combining the above resins into a core-shell latex, there can be obtained excellent fix and acceptable gloss.

The advantages thereof of the carriers of the present invention include in embodiments high robust carrier tribo charge of a positive value, high toner tribo charge of a negative value, excellent admix, for example from about 1 to about 30 seconds as determined in the charge spectrograph, and the like; more specifically, the toner tribo can be, for example, from about a minus 50 to about a minus 150, from about a minus 55 to about a minus 90, or from about a minus 60 to about a minus 85, with corresponding positive tribo charges for the carrier; increased resistance of the carrier to mechanical aging in a xerographic environment and a decreased sensitivity of the carrier triboelectric value to the relative humidity of the environment. The tribo can be determined by a number of known methods, such as the use of a Faraday Cage. With respect to high toner tribo charge of a negative value, this property is of interest for xerographic, especially color applications, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

REFERENCE TO U.S. PATENTS

A number of coated carriers have been disclosed, reference for example the patents recited hereinbefore and also, for example, U.S. Pat. No. 3,590,000. Emulsion/aggregation/coalescence processes for the preparation of toners are illustrated in a number of Xerox patents, the disclosures of each of which are totally incorporated herein by reference, such as U.S. Pat. No. 5,290,654, U.S. Pat. No.

5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,726; 5,366,841; 5,496,676; 5,527,658; 5,585,215; 5,650,255; 5,650,256 and 5,501,935 (spherical toners). The appropriate components and processes of the above Xerox patents can be selected for the present invention in embodiments thereof.

SUMMARY OF THE INVENTION

It is a feature of the present invention to provide coated carriers and developers thereof containing toner with many of the advantages illustrated herein and more specifically wherein high stable carrier turboelectric charging is achievable.

More specifically, a feature of the present invention relates to the preparation of coated carrier particles and wherein the coating is generated from latexes, especially latex particles having a core/shell morphology by a semicontinuous, consecutive emulsion polymerization in sequence with different monomers and wherein the second stage monomer is polymerized in the presence of seed latex particles, and which seed particles can be prepared separately, or formed in situ and wherein control latexes with appropriate $M_n$s, $M_w$s, and Tgs whereby the core polymer gloss and the shell polymer controls fix.

In another feature of the present invention there are provided simple and economical processes for the preparation of coated carrier particles and which coating is prepared from latexes of a core and a shell thereover and wherein the extent of carrier turboelectric charging can be varied and preselected by the regions in which electropositive components such as amino methacrylate polymers are dispersed in the coating surface, and wherein high viscosity carrier cores of a high electropositive charge undergo film formation based primarily on the increased flow characteristics of the shell.

In a further feature of the present invention there is provided a process for the preparation of carrier particles by aggregation and coalescence, or fusion (aggregation/coalescence) of a structured latex and a carrier core.

EMBODIMENT EXAMPLES

The present invention relates, for example, to coated carriers and wherein the coating or coatings are generated form core-shell latexes. More specifically the core-shell latexes can be prepared by emulsion polymerization. The resulting latex polymer composition can be comprised of a core-shell latex wherein the latex particles comprise, for example, about 10 to 60 percent, and more specifically, about 20 to 50 percent, by weight of a polymeric core and for example, about 40 to 90 percent, and more specifically, about 50 to 80 percent by weight of a polymeric shell thereover. The core is formed by emulsion polymerization of a first-stage monomer composition, and the shell is formed on the core by emulsion polymerization of a further stage second dissimilar monomer than the core monomer composition, in the presence of the core polymer. The monomers of the first monomer composition are, for example, selected in a manner to provide a glass transition temperature (Tg) in the core of, for example, about 20° C. to about 50° C., and more specifically, about 30° C. to about 50° C., and a weight average molecular weight ($M_w$) of, for example, about 5,000 to about 30,000, and more specifically of, for example, about 8,000 to about 25,000, and the second shell forming monomer composition which forms the polymer shell that encapsulates the core are selected in a manner to provide, for example, a Tg in the shell of, for example, about 50° C. to about 70° C., and more specifically, about 55° C. to about 65° C., and a $M_w$ of 30,000 or higher, or more specifically, of 40,000 or higher, such as about 40,000 to about 200,000. More specifically, the preparation of a latex is accomplished by a semicontinuous, emulsion polymerization sequence wherein the monomer mixture used to prepare the core and the shell polymers have different monomer compositions and, for example, dissimilar chain transfer concentrations. Specifically, the core can be formed by first preparing an initial aqueous resin, or polymer latex with a resin glass transition temperature (Tg) of about 20° C. to about 50° C., and more specifically, about 30° C. to about 50° C., and a weight average molecular weight ($M_w$) of about 5,000 to about 30,000, and more specifically, of about 8,000 to about 25,000, by emulsion polymerization of a first (core) monomer composition by (i) conducting a pre-reaction monomer emulsification which comprises the emulsification of the polymerization reagents of monomers, chain transfer agent, water, surfactant, and an initiator, and wherein the emulsification is accomplished, although other temperatures may be suitable, at a low temperature of, for example, from about 5° C. to about 40° C.;

(ii) preparing a seed particle latex by the aqueous emulsion polymerization of a mixture comprised of part of the monomer emulsion (i), from about 0.5 to about 50 percent by weight, and more specifically, from about 3 to about 25 percent by weight; and then adding it to a reactor containing a liquid solution of water, and surfactant or surfactants;

(iii) adding to the monomer emulsion in (ii) free radical initiator, from about 0.5 to about 100 percent by weight, and more specifically, from about 3 to about 100 percent by weight for example, of total initiator used to prepare the core copolymer resin, and heating at a temperature of from about 35° C. to about 125° C., wherein the reaction of the free radical initiator and monomer produces the seed latex comprised of latex resin (the reaction products of monomers and initiator; and wherein the particles are stabilized by surfactants);

(iv) heating and feed adding to the formed seed particles the remaining monomer emulsion (ii) from about 50 to about 99.5 percent by weight, and more specifically, from about 75 to about 97 percent by weight used to prepare the core copolymer, and free radical initiator, from about 0.5 to about 99.5 percent by weight, and more specifically from about 1 to about 97 percent by weight of total initiator used to prepare the copolymer resin, and which heating is at a temperature from about 35° C. to about 125° C., and (v) retaining the resulting components in for example, a reactor at a temperature of from about 35° C. to about 125° C. for an effective time period, for example from about 0.1 to about 10 hours, and more specifically from about 0.5 to about 4 hours and subsequently generating the polymer shell, or coating;

Embodiments of the present invention relate to for example, a process for the preparation of a latex comprising a core polymer and a shell thereover and wherein the core polymer is generated by (A)

(i) emulsification and heating of the polymerization reagents of monomer, chain transfer agent, water, surfactant, and initiator;

(ii) generating seed latex particles by the aqueous emulsion polymerization of a mixture comprised of part of the (i) monomer emulsion, for example, from about 0.4 to about 50 percent by weight, and a free radical initiator, and which polymerization is accomplished by heating, and wherein the reaction of the free radical initiator and monomer produces a seed latex containing a polymer;

(iii) heating and adding to the formed seed particles of (ii) the remaining monomer emulsion of (i), from about 50 to about 99.6 percent by weight of monomer emulsion of (i) and free radical initiator;

(iv) whereby there is provided core polymer; and (B) forming a shell thereover the core generated polymer and which shell is generated by emulsion polymerization of a second monomer in the presence of the core polymer, which emulsion polymerization is accomplished by (i) emulsification and heating of the polymerization reagents of monomer, chain transfer agent, surfactant, and an initiator;

(ii) adding a free radical initiator and heating;

(iii) whereby there is provided a shell polymer;

thereafter, the core shell product can be blended and heated with a carrier core to provide a coated carrier with a fused core shell thermoplastic resin.

The shell can be formed on the core by emulsion polymerization of a second monomer composition in the presence of the core polymer, and more specifically, there is polymerized a second (for the shell) monomer having a glass transition temperature in the shell of, for example, about 50° C. to about 70° C., and more specifically, about 55° C. to about 65° C., and a weight average molecular weight of about 30,000 to about 100,000, and yet more specifically, of about 40,000 to about 80,000, by (i) conducting a pre-reaction monomer emulsification, which comprises emulsification of the polymerization reagents of monomers, and a chain transfer agent, surfactant, and an initiator, and wherein the emulsification is accomplished at a temperature of, for example, from about 5° C. to about 45° C.;

(ii) feed adding to the formed core latex particles the monomer emulsion used to prepare the shell copolymer, and an optional free radical initiator, from about 0.5 to about 99.5 percent by weight, and more specifically, from about 0 to about 97 percent by weight of total initiator used to prepare the shell copolymer resin, and heating at a temperature of, for example, from about 35° C. to about 125° C., and (iii) retaining the resulting mixture at a temperature of for example, from about 35° C. to about 125° C. for an effective time period, for example from about 0.5 to about 6 hours, and more specifically, from about 1 to about 4 hours, followed by cooling to about room temperature, and wherein there results the desired core-shell latex comprised of a polymer core having a glass transition temperature (Tg) of, for example, about 20° C. to about 50° C., and more specifically, about 30° C. to about 50° C., and a weight average molecular weight ($M_w$) of, for example, about 5,000 to about 30,000, and more specifically, of about 8,000 to about 25,000, and a polymer shell with, for example, a glass transition temperature of about 50° C. to about 70° C., and more specifically, about 55° C. to about 65° C., and a weight average molecular weight of, for example, about 30,000 to about 100,000, and more specifically, about 40,000 to about 80,000, and wherein the polymer shell possesses a suitable thickness of, for example, about 0.01 microns to about 0.3 micron, and more specifically of about 0.03 micron to about 0.2 micron.

The core-shell latexes can be prepared by a semicontinuous, and consecutive emulsion polymerization sequences wherein the monomer mixture used to prepare the core and the shell polymers have different monomer compositions and/or similar chain transfer agent concentrations. More specifically, the core can be formed by first preparing an initial aqueous resin latex wherein the resin possesses a glass transition temperature (Tg) of about 50° C., and more specifically, about 30° C. to about 50° C., and a weight average molecular weight ($M_w$) of about 5,000 to about 30,000, and more specifically, of about 8,000 to about 25,000, by emulsion polymerization of a first (core) monomer composition by (i) accomplishing a pre-reaction monomer emulsification, which comprises emulsification of the polymerization reagents of monomers, chain transfer agent, water, surfactant, and an initiator, and wherein the emulsification is accomplished at a temperature of, for example, from about 5° C. to about 40° C.;

(ii) preparing seed latex particles by an aqueous emulsion polymerization of a mixture comprised of part of the monomer emulsion, from about 0.5 to about 50 percent by weight, and more specifically from about 3 to about 20 percent by weight of monomer emulsion prepared in (i);

(iii) adding to the monomer emulsion in (ii) a free radical initiator, from about 0.5 to about 100 percent by weight, and more specifically, from about 3 to about 100 percent by weight of total initiator used to prepare the core polymer resin, and heating at a temperature of from about 35° C. to about 125° C., wherein the reaction of the free radical initiator and monomer produces the seed latex comprised of latex resin (the reaction products of monomers and initiator; and wherein the particles are stabilized by surfactants);

(iv) heating and feed adding to the formed seed latex the remaining monomer emulsion, from about 50 to about 99.5 percent by weight, and more specifically, from about 80 to about 97 percent by weight of monomer emulsion prepared in (ii) used to prepare the core copolymer, and free radical initiator, and which heating is at a temperature of, for example, from about 35° C. to about 125° C.,; and (v) retaining the resulting mixture at a temperature of from about 35° C. to about 125° C. for an effective time period, for example from about 0.1 to about 2 hours, and more specifically from about 0.5 to about 4 hours, and wherein there results a core comprised of a polymer of for example, styrene, butadiene, isoprene, (meth)acrylates esters, acrylonitrile, (meth)acrylic acid, or mixtures thereof and wherein the polymer optionally possess a glass transition temperature (Tg) of about 20° C. to about 50° C., and a weight average molecular weight ($M_w$) of about 5,000 to about 30,000.

The shell or coating is then formed on the polymer core by emulsion polymerization of a second different monomer than is selected for the polymer core, however, the core and shell can be similar or dissimilar in monomer compositions. The Tg and $M_w$ of the polymer core can differ from the Tg and $M_w$ of the polymer shell. When the core and the shell contain a similar monomer, and thus polymer composition, and the ratio of the constituents is similar, the core and the shell can possess different Tg and $M_w$ by using a different amount of chain transfer agent, such as 1-dodecanethiol. More specifically, the shell can be formed by polymerizing a second (shell) monomer having a shell glass transition temperature of about 50° C. to about 70° C., and more specifically, about 55° C. to about 65° C., and a weight average molecular weight of about 30,000 to about 200,000, and more specificall, of about 40,000 or to about 80,000 in the presence of the first prepared core polymer latex by emulsion polymerization by conducting a pre-reaction monomer emulsification, which comprises emulsification of the polymerization reagents of monomers, chain transfer agent, surfactant, and an initiator, and wherein the emulsification is accomplished at a temperature of, for example, from about 5° C. to about 40° C.;

(ii) feed adding to the formed core latex particles comprised, for example, of a polymer of styrene, butadiene, isoprene, (meth)acrylates esters, acrylonitrile, (meth)acrylic acid, and mixtures thereof and wherein in the core latex, the core resin particulates are typically present in amounts of from about 5 to about 50, and more specifically, from about 20 to about 40 percent by weight, water (the dispersing medium) in amounts of typically from about 50 to about 94, and more specifically, from about 60 to about 80 percent by weight, and wherein surfactant amounts typically range from about 0.01 to about 10, and more specifically, from about 0.5 to about 5 percent in weight, residual initiator and chain transfer agents and fragments thereof in amounts typically each or the total thereof of from about 0.01 to about 10 percent, and more specifically, from about 0.05 to about 5 percent by weight of the total emulsion polymerization mixture selected for the preparation of the core latex, and (iii) retaining the resulting components at a temperature of from about 35° C. to about 125° C. for an effective time period, for example from about 0.5 to about 6 hours, and more specifically, from about 1 to about 4 hours, followed by cooling and wherein these results a core/shell latex comprised of about 10 to 60 percent, and more specifically 20 to 50 percent, by weight of a polymeric core and about 40 to 90 percent, percent 50 to 80 percent, by weight of a polymeric shell thereover, and wherein the polymer shell has a thickness of, for example, about 0.01 microns to about 0.3 microns, and more specifically of about 0.03 microns to about 0.2 microns. Embodiments of the present invention also include a process wherein the addition of the shell monomer emulsion to the core latex particles is accomplished in a time period of about 0.5 to about 8 hours, and more specifically about 1 to about 5 hours, and wherein the core latex particles generated can be of average particle size, such as from about 0.05 to about 0.5 micron, and more specifically from about 0.1 to about 0.3 micron in volume average diameter as measured by the light scattering technique on a Coulter N4 Plus Particle Sizer.

Aspects of the present invention include the generation of coatings or a coating for a carrier core and wherein the coating is prepared by forming a (A) core polymer from an aqueous latex containing at least water and a polymer of, for example, styrene, butadiene, isoprene, (meth)acrylates esters, acrylonitrile, (meth)acrylic acid, or mixtures thereof, and wherein the polymer possesses for example, a glass transition temperature (Tg) of about 20° C. to about 50° C., and a weight average molecular weight ($M_w$) of about 5,000 to about 30,000, and which polymer is present in an amount of from about 5 to about 50, and wherein the water is present in an amount of from about 50 to about 94; initiator and chain transfer agent are each present in an amount of about 0.01 to about 10 percent by weight of the latex mixture and which latex is generated by the emulsion polymerization of a first core monomer by (i) emulsification of monomer, chain transfer agent, water, surfactant, and initiator, and wherein the emulsification is accomplished at a temperature of from about 50° C. to about 40° C.;

(ii) generating a seed latex by the aqueous emulsion polymerization of a mixture comprised of part of the (i) monomer emulsion, from about 0.5 to about 50 percent by weight, and a free radical initiator, from about 0.5 to about 100 percent by weight of total initiator used to prepare the core polymer resin, which polymerization is accomplished, at a temperature of from about 35° C. to about 125° C. and, wherein the reaction of the free radical initiator and monomer generates a seed latex;

(iii) heating and adding to the formed seed particles of (ii) the remaining monomer emulsion from about 50 to about 99.5 percent by weight of monomer emulsion of (i) and free radical initiator, from about 0 to about 99.5 percent by weight of total initiator used to prepare the polymer resin and which heating is at a temperature from about 35° C. to about 125° C.; and (iv) retaining the above mixture of (iii) at a temperature of from about 35° C. to about 125° C. to provide the core polymer comprised of, for example, known polymers such as, styrene, butadiene, isoprene, (meth)acrylates esters, acrylonitrile, (meth)acrylic acid, of mixtures thereof and wherein the core polymer possesses a glass transition temperature (Tg) of about 20° C. to about 50° C., and a weight average molecular weight ($M_w$) of about 5,000 to about 30,000; and (B) forming a shell thereover the core generated polymer and which shell is generated by emulsion polymerization of a second monomer, in the presence of the core polymer by polymerizing a second monomer with a glass transition temperature of, for example, about 50° C. to about 70° C., and a weight average molecular weight of for example, about 30,000 to about 100,000, which emulsion polymerization is accomplished by (i) emulsification of monomer, chain transfer agent, surfactant, and initiator, and wherein the emulsification is accomplished at a low temperature of, for example, from about 5° C. to about 40° C.;

(ii) adding over a suitable period of time, for example about 0.5 to about 10 hours, a free radical initiator, from about 1 to about 99.5 percent by weight, and heating at a temperature from about 35° C. to about 125° C., and (iii) retaining the resulting core-shell polymer colloid dispersed in water at a temperature of from about 30° C. to about 130° C. for a period of for example, about 0.5 to about 10 hours, followed by cooling and wherein in the resulting core-shell polymer latex, the core-shell polymer is present in an amount of, for example, from about 5 to about 60 percent by weight, the water is present in an amount of from about 40 to about 94 percent by weight, the surfactant is present in an amount of from about 0.01 to about 10 percent by weight, and residual initiator and chain transfer agents and fragments thereof are each present, or wherein are present in total in an amount of about 0.01 to about 5 percent by weight of the total emulsion polymerization mixture, the polymer core possessing, for example, a glass transition temperature (Tg) of about 20° C. to about 50° C., and a weight average molecular weight ($M_w$) of about 5,000 to about 30,000, and the polymer shell possessing a glass transition temperature of about 50° C. to about 70° C., and a weight average molecular weight of about 30,000 to about 100,000, wherein the polymer shell possesses a thickness of about 0.01 microns to about 0.3 microns, and wherein the latex formed is comprised of a core of a polymer comprising, for example, styrene, butadiene, isoprene, (meth) acrylates esters, acrylonitrile, (meth)acrylic acid, and mixtures thereof and a shell of a polymer comprising for example, styrene, (meth)acrylates esters, acrylonitrile, (meth)acrylic acid, and mixtures thereof, and wherein the core and shell polymer are dissimilar; a process wherein the core polymer with a glass transition temperature (Tg) of about 30° C. to about 50° C., possesses a weight average molecular weight ($M_w$) of about 8,000 to about 25,000, and the core latex contains about 50 to about 90 percent by weight of water, and from about 65 to about 95 of surfactant, wherein the (ii) seed particle latex contains from about 3 to about 25 percent by weight of the emulsion prepared in (i); adding to the core monomer emulsion in (ii) a free radical initiator in an amount of about 3 to about 100 percent by weight of total initiator used to prepare the core polymer resin; (iv) heating and feed adding to the formed core seed particles of (iii) the remaining monomer emulsion from about 75 to about 97 percent by weight of monomer emulsion prepared in (ii) and free radical initiator from about 0 to about 97 percent by weight of total initiator used, and retaining the mixture at a temperature of from about 35° C. to about 125° C. for from about 0.1 to about 10 hours; a process wherein a carrier is prepared by heating a mixture of a polymer latex with a core-shell structure, or a polymeric colloid comprised of a latex of polymeric core encapsulated in a polymeric shell, and a colorant dispersion below about or equal to about the polymer latex glass transition temperature to form aggregates, followed by heating above about or equal to about the polymer glass transition temperature to coalesce or fuse the aggregates; a coated carrier wherein there is selected for the structured coating a core polymer of poly(styrene-alkyl acrylate), poly(styrene-1,3-diene), poly(styrenealkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate-acrylic acid), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), and a shell polymer of poly(styrene-butadiene), poly(alkyl methacrylate-butadiene), poly (styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate-acrylic acid), poly(styrene-butadiene-acrylic acid), poly(alkyl acrylate-butadiene-acrylic acid), poly(alkyl methacrylate-butadiene-acrylic acid), poly(alkyl methacrylate-acrylic acid), poly(styrene-alkyl acrylate-acrylonitrile-acrylic acid), poly(styrene-1,3-diene-acrylonitrile-acrylic acid), or poly(alkyl acrylate-acrylonitrile-acrylic acid), and wherein the core polymer is present for example, in an amount of from about 10 to about 60 weight percent, or parts, and the shell polymer is present in an amount of from about 40 to about 90 weight percent or parts; wherein there is selected for the core polymer poly (styrene-butadiene), poly(methyl methacrylate-butadiene), poly(ethyl methacrylate-butadiene), poly (propyl methacrylate-butadiene), poly(butyl methacrylate-butadiene), poly(styrene-isoprene), poly (methyl methacrylate-isoprene), poly(ethyl methacrylate-isoprene), poly(propyl methacrylate-isoprene), poly(butyl methacrylate-isoprene), poly (styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly(styrene-butyl acrylate-acrylononitrile), and poly(styrene-butyl acrylate-acrylononitrile-acrylic acid), poly(methyl methacrylate-propyl acrylate), poly (methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid); and wherein the shell polymer includes known polymers such as poly (styrene-butadiene), poly(methyl methacrylate-butadiene), poly(styrene-isoprene), poly(methyl methacrylate-isoprene), poly(ethyl methacrylate-isoprene), poly(butyl methacrylate-isoprene), poly (styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly(styrene-butyl acrylate-acrylononitrile), poly (styrene-butyl acrylate-acrylononitrile-acrylic acid), poly(methyl methacrylate-propyl acrylate), poly (methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), or poly(styrene-butyl acrylate-acrylononitrile-acrylic acid), and wherein similar polymers can also be selected for the shell polymer; a coated carrier comprised of a known carrier core, like a ferrite, steel, and the like and thereover a coating generated from a latex comprised of a core and a shell thereover comprising (A) generating a core polymer latex by (i) emulsification of the monomer, chain transfer agent, water, surfactant, and initiator, and wherein the emulsification is accomplished by heating at a temperature of, for example, from about 5° C. to about 40° C.; and optionally mixing with a liquid composition comprising water, and surfactant;

(ii) preparing a seed particle latex by aqueous emulsion polymerization of a mixture comprised of part of the (i) monomer emulsion, for example, from about 0.5 to about 50 percent by weight;

(iii) adding to the monomer emulsion in (i) a free radical initiator from, for example, about 0.5 to about 100 percent by weight, at a temperature of from about 35° C. to about 125° C., wherein the reaction of the free radical initiator and monomer generates a seed latex comprised of latex resin, the reaction product of monomer and initiator, and wherein the particles are stabilized by a surfactant;

(iv) heating and feed adding to the formed seed particles of (iii) the remaining monomer emulsion from about 50 to about 99.5 percent by weight of monomer emulsion prepared in (ii) and free radical initiator, from about 0 to about 99.5 percent by weight of total initiator at a temperature from about 35° C. to about 125° C., and (v) retaining the above mixture at a temperature of from about 35° C. to about 125° C. to provide the core polymer latex comprised of a polymer comprising styrene, butadiene, isoprene, (meth)acrylates esters, acrylonitrile, (meth)acrylic acid, and mixtures thereof, wherein the core polymer glass transition temperature (Tg) is about 20° C. to about 50° C., with a weight average molecular weight ($M_w$) of about 5,000 to about 30,000, and wherein the core latex, the polymer is present in an amount of from about 5 to about 50, or from about 20 to about 40 percent by weight, the water is present in an amount of from about 50 to about 94, or from about 60 to about 80 percent by weight, the surfactant amount is from about 0.01 to about 10, or from about 0.5 to about 5 percent by weight, and said initiator, chain transfer agent, and fragments thereof are each present in an amount of from about 0.01 to about 10, or from about 0.05 to about 5 percent by weight of the total emulsion polymerization mixture; and (B) forming a shell thereover in the presence of the core polymer and which shell is generated by the emulsion polymerization of a second monomer by polymerizing the second monomer possessing a glass transition temperature of about 50° C. to about 70° C., or about 55° C. to about 65° C, and a weight average molecular weight of about 30,000 to about 100,000, or about 40,000 to about 80,000;

(i) a process comprising conducting a pre-reaction monomer emulsification which comprises emulsification of the polymerization reagents of monomer, chain transfer agent, surfactant, and an initiator, and wherein said emulsification is accomplished at a low temperature of from about 5° C. to about 40° C.;

(ii) feed adding to the formed core latex particles the shell monomer emulsion of (i), and an optional free radical initiator, from about 0 to about 99.5 percent by weight, or from about 0 to about 97 percent by weight of total initiator used to prepare the shell polymer resin, at a temperature from about 35° C. to about 125° C., and (iii) retaining the above core-shell polymer emulsion at a temperature of about 95° C. to about 125° C. and wherein there results a coreshell polymer latex comprising a polymer core with a glass transition temperature (Tg) of about 20° C. to about 50° C., and a weight average molecular weight ($M_w$) of about 5,000 to about 30,000, the polymer shell possessing a glass transition temperature of about 50° C. to about 70° C., and a weight average molecular weight of about 30,000 to about 100,000, wherein the polymer shell possesses a thickness of about 0.01 micron to about 0.3 micron, and wherein the coating for the carrier core comprises a core polymer and a shell polymer and more specifically, wherein core polymer is selected from the group consisting of poly(styrene-butadiene), poly(alkyl acrylate-butadiene), poly(alkyl methacrylate-butadiene), poly (styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate-acrylic acid), poly(styrene-butadiene-acrylic acid), poly(alkyl acrylate-butadiene-acrylic acid), poly(alkyl methacrylate-butadiene-acrylic acid), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), and wherein the second shell polymer is selected from the group consisting of poly(styrene-butadiene), poly(alkyl methacrylate-butadiene), poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate-acrylic acid), poly(styrene-butadiene-acrylic acid), poly(alkyl acrylate-butadiene-acrylic acid), poly(alkyl methacrylate-butadiene-acrylic acid), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), or wherein the core latex resin is selected from the group consisting of poly(styrene-butadiene), poly(methyl methacrylate-butadiene), poly(ethyl methacrylate-butadiene), poly (propyl methacrylate-butadiene), poly(butyl methacrylate-butadiene), poly(styrene-isoprene), poly (methyl methacrylate-isoprene), poly(ethyl methacrylate-isoprene), poly(propyl methacrylate-isoprene), poly(butyl methacrylate-isoprene), poly (styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly(styrene-butyl acrylate-acrylononitrile), and poly(styrene-butyl acrylate-acrylononitrile-acrylic acid), poly(methyl methacrylate-propyl acrylate), poly (methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid), similar polymers and the like, and the shell is selected from the group consisting of poly(styrene-butadiene), poly(methyl methacrylate-butadiene), poly(styrene-isoprene), poly(methyl methacrylate-isoprene), poly(ethyl methacrylate-isoprene), poly(butyl methacrylate-isoprene), poly (styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly(styrene-butyl acrylate-acrylononitrile), and poly(styrene-butyl acrylate-acrylononitrile-acrylic acid), poly(methyl methacrylate-propyl acrylate), poly (methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid), and the like, and wherein the coating coverage is from for example about 75 to about 100 percent, and more specifically from about 80 to about 99 percent; or wherein the carrier coating is formed from a latex emulsion comprised of first and second resin particles in the size range of from about 0.5 to about 3 microns, and wherein the generated core-shell latex (in the core-shell polymer latex, are typically present in amounts of from about 5 to about 60, and more specifically from about 25 to about 50 percent by weight, the water (the dispersing medium) is present in amounts of typically from about 40 to about 94, and more specifically from about 50 to about 75 percent by weight, surfactant is present in amounts of from about 0.01 to about 10, and more specifically, from about 0.5 to about 5 percent by weight, and residual initiator chain transfer agents and fragments thereof are each present in amounts that typically are from about 0.01 to about 5, more specifically, from about 0.05 to about 1 percent by weight of the total emulsion polymerization mixture, comprised of core-shell polymer particles, submicron in size, of from, for example, about 0.05 micron to about 0.5 micron in volume average diameter.

Examples of monomers selected for the formation of the polymeric core include styrene, butadiene, isoprene, acrylates, methacrylates, acrylonitrile, acrylic acid, methacrylic acid, and mixtures thereof, and the preferred monomers for the polymeric shell include styrene, acrylates, methacrylates, acrylonitrile, acrylic acid, methacrylic acid, and the mixtures thereof. Polymer core examples include poly(styrene-butadiene), poly(methyl methacrylate-butadiene), poly(ethyl methacrylate-butadiene), poly(propyl methacrylate-butadiene), poly(butyl methacrylate-butadiene), poly(styrene-isoprene), poly(methyl methacrylate-isoprene), poly(ethyl methacrylate-isoprene), poly(propyl methacrylate-isoprene), poly(butyl methacrylate-isoprene), poly(styrene-propyl acrylate), poly (styrene-butyl acrylate), poly(styrene-2-ethylhexyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid). Examples of shell polymers include poly(styrene-butadiene), poly(methyl methacrylate-butadiene), poly(styrene-isoprene), poly(methyl methacrylate-isoprene), poly(ethyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid).

In embodiments, examples of core polymers selected for the process of the present invention include poly(styrene-butadiene), poly(methyl methacrylate-butadiene), poly (ethyl methacrylate-butadiene), poly(propyl methacrylate-butadiene), poly(butyl methacrylate-butadiene), poly (styrene-isoprene), poly(methyl methacrylate-isoprene), poly(ethyl methacrylate-isoprene), poly(propyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly(styrene-butyl acrylate-acrylononitrile), poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly (methyl methacrylate-butyl acrylate-acrylic acid), poly (methyl methacrylate-butyl acrylate-methacrylic acid), poly (methyl methacrylate-butyl acrylate-acrylononitrile), poly (styrene-butyl acrylate-acrylononitrile-acrylic acid), and the like, and wherein the shell polymers selected for the process of the present invention include known polymers such as poly(styrene-butadiene), poly(methyl methacrylate-butadiene), poly(styrene-isoprene), poly(methyl methacrylate-isoprene), poly(ethyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), poly(styrene-butyl acrylate-acrylononitrile-acrylic acid), and the like. More specifically, the latex can be comprised of a mixture of two polymers, each in an amount of about 50 weight percent, and wherein the first polymer is poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(methyl methacrylate-butyl acrylate), poly(methyl methacrylate-butyl acrylate-acrylic acid), poly(butyl methacrylate-butyl acrylate), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the second polymer is poly(styrene-butylacrylate), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(methyl methacrylate-butyl acrylate), poly(methyl methacrylate-butyl acrylate-acrylic acid), poly(butyl methacrylate-butyl acrylate), poly(butyl methacrylate-acrylic acid), poly (styrene-butyl acrylate-acrylonitrile-acrylic acid), poly (acrylonitrile-butyl acrylate-acrylic acid).

Known chain transfer agents, for example dodecanethiol from, for example, about 0.1 to about 10 percent, or carbon tetrabromide in effective amounts, such as for example from about 0.1 to about 10 percent, can be utilized to for example, control the molecular weight properties of the polymer when emulsion polymerization is selected. Examples of chain transfer agents include dodecane thiol, octane thiol, carbon tetrabromide and the like selected in various suitable amounts, such as in the amount of from about 0.1 to about 10 percent, and more specifically, of from about 0.2 to about 5 percent by weight of monomer. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; and polymer solution microsuspension process, such as disclosed in U.S. Pat. No. 5,290,654, the disclosure of which is totally incorporated herein by reference, mechanical grinding processes, or other known processes.

Examples of initiators selected include water soluble initiators such as persulfates like ammonium and alkali, like potassium persulfates in suitable amounts, such as from about 0.1 to about 8 percent and more specifically from about 0.2 to about 5 percent (weight percent). Examples of organic soluble initiators include VAZO peroxides, such as VAZO 64™, 2-methyl 2-2'-azobis propanenitrile, VAZO 88™, 2-2'-azobis isobutyramide dehydrate in a suitable amount, such as in the range of from about 0.1 to about 8 percent. Known free radical initiators can also be selected as indicated herein, and which initiators can be selected in various suitable amounts, for example from about 0.5 to about 100, and more specifically for example, about 5 to about 50 parts, or weight percent.

Examples of surfactants include known anionic, cationic and the like surfactants such as, for example, TRITON X-4045™, reference the appropriate U.S. Patents recited herein; the disclosures of which are totally incorporated herein by reference.

Various suitable solid core carrier materials can be selected for the carriers and developers of the present invention. Characteristic core properties include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide and available from D. M. Steward Corporation or Powdertech Corporation, Ni/Zn-ferrite available from Powdertech Corporation, Sr (strontium)-ferrite, containing, for example, about 14 percent strontium oxide and 86 percent iron oxide and available from Powdertech Corporation Ba-ferrite, magnetites, available, for example, from Hoeganaes Corporation (Sweden), nickel, mixtures thereof, and the like. Specific carrier cores include ferrites, and sponge iron, or steel grit with an average particle size diameter of, for example, from between about 30 microns to about 400 microns, and preferably from about 50 to about 50 microns.

Developer compositions can be prepared by mixing the obtained carrier particles, including coated carriers with cores such as steel, ferrites, and the like, reference U.S. Pat. Nos. 4,937,166 and 4,935,326, the disclosures of which are totally incorporated herein by reference, with for example from about 2 percent toner concentration to about 8 percent toner concentration. The carrier particles can also be comprised of a core with a structured polymer coating thereover, such as polymethylmethacrylate (PMMA) having dispersed therein a conductive component like conductive carbon black. Further carrier coatings include silicone resins, fluoropolymers, mixtures of resins not in close proximity in the triboelectric series, thermosetting resins, and other known components.

Various effective suitable processes can be selected to apply the polymer, or mixture, for example from two to about five, and preferably two, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating may be selected to enable the formation of a continuous film of the coating polymer on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers. In addition to the coating of the structured latex, further or additional coatings may be applied to a carrier core like a ferrite, such as the further coatings illustrated in the copending applications recited herein, and more specifically, U.S. Pat. No. 6,004,712, the disclosure of which is totally incorporated herein by reference; or a polyurethane polyester.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins, such as ethylene, propylene, butylene and isobutylene; vinyl halides, such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof, known cyan, magenta, yellow pigments, and dyes. The colorant, which is preferably carbon black, should be present in a sufficient amount to render the toner composition highly colored. Thus, the colorant can be present in amounts of, for example, from about 1 percent by weight to about 20, and preferably from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like, inclusive of dyes thereof can be selected. These colorants are generally present in the toner composition in an amount of from about 1 weight percent to about 15, and, for example, from about 2 to about 12 weight percent based on the weight of the toner components of binder and colorant.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and, for example, from about 3 to about 12 percent by weight. These charge additives can also be dispersed in the carrier polymer coating as indicated herein.

The toner can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particles sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990; 4,585,884; 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

The following Examples are being submitted to further illustrate various aspects of the present invention. These Examples are intended to be illustrative only and are not intended to limit the scope of the present invention.

SYNTHETIC EXAMPLE I

A core-shell latex polymer comprised of a polymer core of methyl methacrylate (MMA)/diisopropylaminoethyl methacrylate (DIAEMA) of 98/2 parts (by weight throughout unless otherwise indicated) in composition, and a polymer shell of methyl methacrylate (MMA)/diisopropylaminoethyl methacrylate (DIAEMA) of 86/14 parts (by weight) in composition, and an overall 50:50 weight ratio of core:shell based on the initial charge of reactants, was prepared by a semicontinuous, sequential emulsion polymerization process as follows. A 2 liter jacketed glass flask with a stirrer set at 200 rpm (revolutions per minute), and containing 2.5 grams of the anionic surfactant sodium dodecyl sulfate (available from Aldrich Chemicals), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to 65° C. The first-stage monomer emulsion (core) was prepared by homogenizing a monomer mixture of 273 grams of methyl methacrylate (MMA) and 5.6 grams of diisopropylaminoethyl methacrylate (DIAEMA) with an aqueous solution (0.6 grams of sodium dodecyl sulfate, 1 gram of TRITON X-405™, and 125 grams of deionized water, at 10,000 rpm for 5 minutes at room temperature of about 25° C. by a VirTishear Cyclone Homogenizer. The second-stage monomer emulsion (shell) was prepared by homogenizing a monomer mixture of 239 grams of methyl methacrylate (MMA) and 39 grams diisopropylaminoethyl methacrylate (DIAEMA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Twenty-one (21) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow seed particle formation. The remaining 384 grams of first-stage monomer emulsion were then fed continuously into the reactor over a period of about 2 hours and 10 minutes. At the conclusion of the first-stage monomer emulsion feed, the resulting batch was held at 65° C. for 10 minutes. A second-stage monomer emulsion was then fed continuously into the reactor over a period of 2 hours and 20 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a high molecular weight core having an $M_w$ of 461,000 and a shell having an $M_w$ of 389,000, as determined on a Waters GPC. The resulting latex has an average mid-point Tg of 105° C., as measured on a Seiko DSC. The latex product includes both core and shell polymer. This core-shell latex resin possessed an volume average diameter of 151 nanometers, wherein the polymer core possesses an volume average diameter of 110 nanometers, as measured by light scattering technique on a Coulter N4 Plus Particle Sizer, and wherein the polymer shell was estimated to have a thickness of about 20 nanometers. The core-shell latex resins possessed a thermal decomposition temperature of 296° C. as measured by thermogravimetric analysis (TGA) on a Hi-Res Auto TGA 2950. The copolymer powder of the above core-shell polymer latex was isolated by freeze drying the latex in vacuum. The resulting number median particle diameter was 185 nanometers as estimated by light scattering of a redispersed aqueous suspension on a Coulter N4 Plus Particle Sizer.

SYNTHETIC EXAMPLE II

A core-shell latex polymer comprised of a polymer core of methyl methacrylate (MMA)/diisopropylaminoethyl methacrylate (DIAEMA) of 98/2 parts (by weight throughout unless otherwise indicated) in composition, and a polymer shell of methyl methacrylate (MMA)/diisopropylaminoethyl methacrylate (DIAEMA) of 86/14 parts (by weight) in composition, and an overall 90:10 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of anionic surfactant sodium dodecyl sulfate (available from Aldrich), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to 65° C. First-stage monomer emulsion (core) was prepared by homogenizing a monomer of 490 grams of methyl methacrylate (MMA), and 10 grams of diisopropylaminoethyl methacrylate (DIAEMA) with an aqueous solution (0.6 gram of sodium dodecyl sulfate, 1 gram of TRITON X-405™, and 125 grams of deionized water) at 10,000 rpm for 5 minutes at room temperature of about 25° C. by a VirTishear Cyclone Homogenizer. Second-stage monomer emulsion (shell) was prepared by homogenizing a monomer mixture of 48 grams methyl methacrylate (MMA) and 7.9 grams of diisopropylaminoethyl methacrylate (DIAEMA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Twenty-two (22) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow a seed particle formation. The remaining 605 grams of first-stage monomer emulsion were then fed continuously into the reactor over 4 hours and 15 minutes. At the conclusion of the first-stage monomer emulsion feed, the resulting batch was held at 65° C. for 10 minutes. A second-stage monomer emulsion was then fed continuously into the reactor over 50 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a high molecular weight core having an $M_w$ of 476,000 and a low molecular weight shell having an $M_w$ of 298,000, as determined on a Waters GPC. The resulting latex has an average mid-point Tg of 117° C., as measured on a Seiko DSC. The latex product includes both core and shell polymer. This core-shell latex resin possessed an volume average diameter of 173 nanometers, wherein the polymer core possesses an volume average diameter of 157 nanometers, as measured by light scattering technique on a Coulter N4 Plus Particle Sizer, wherein the polymer shell was estimated to have a thickness of about 8 nanometers. This core-shell latex resin possessed a thermal decomposition temperature of 315° C. as measured by thermogravimetric analysis (TGA) on a Hi-Res Auto TGA 2950. The copolymer powder of the above core-shell polymer latex was isolated by freeze drying the latex in vacuum. The resulting number median particle diameter was 195 nanometers as estimated by light scattering of a redispersed aqueous suspension on a Coulter N4 Plus Particle Sizer.

SYNTHETIC EXAMPLE III

A core and shell latex polymer comprised of a polymer core of methyl methacrylate (MMA)/diisopropylaminoethyl methacrylate (DIAEMA) of 98/2 parts (by weight throughout unless otherwise indicated) in composition, and a polymer shell of methyl methacrylate (MMA)/diisopropylaminoethyl methacrylate (DIAEMA) of 86/14 parts (by weight) in composition, and an overall 10:90 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of anionic surfactant sodium dodecyl sulfate (available from Aldrich), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to 65° C. First-stage monomer emulsion (core) was prepared by homogenizing a monomer of 55 grams of methyl methacrylate (MMA), and 1.1 grams of diisopropylaminoethyl methacrylate (DIAEMA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Second-stage monomer emulsion (shell) was prepared by homogenizing a monomer mixture of 430 grams methyl methacrylate (MMA) and 70 grams of diisopropylaminoethyl methacrylate (DIAEMA) with an aqueous solution (0.6 gram of sodium dodecyl sulfate, 1 gram of TRITON X-405™, and 125 grams of deionized water at 10,000 rpm for 5 minutes at room temperature of about 25° C. by a VirTishear Cyclone Homogenizer. Eight (8) grams of seed were removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow a seed particle formation. The remaining 175 grams of first-stage monomer emulsion were then fed continuously into the reactor over 1 hours and 30 minutes. At the conclusion of the first-stage monomer emulsion feed, the resulting batch was held at 65° C. for 10 minutes. A second-stage monomer emulsion was then fed continuously into the reactor over 4 hours and 5 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a high molecular weight core having an $M_w$ of 447,000 and a low molecular weight shell having an $M_w$ of 323,000, as determined on a Waters GPC. The resulting latex has an average mid-point Tg of 88° C., as measured on a Seiko DSC. The latex product includes both core and shell polymer. This core-shell latex resin possessed an volume average diameter of 148 nanometers, wherein the polymer core possesses an volume average diameter of 68 nanometers, as measured by light scattering technique on a Coulter N4 Plus Particle Sizer, wherein the polymer shell estimated to have a thickness of about 40 nanometers. This core-shell latex resin possessed a thermal decomposition temperature of 263° C. as measured by thermogravimetric analysis (TGA) on a Hi-Res Auto TGA 2950 The copolymer powder of the above core-shell polymer latex was isolated by freeze drying the latex in vacuum. The resulting number median particle diameter was 177 nanometers as estimated by light scattering of a redispersed aqueous suspension on a Coulter N4 Plus Particle Sizer.

SYNTHETIC EXAMPLE IV

A core-shell latex polymer comprised of a polymer core of methyl methacrylate (MMA)/diisopropylaminoethyl methacrylate (DIAEMA) of 86/14 parts in composition, and a polymer shell of methyl methacrylate (MMA)/diisopropylaminoethyl methacrylate (DIAEMA) of 86/14 parts by weight) in composition, and an overall 50:50 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of anionic surfactant sodium dodecyl sulfate (available from Aldrich), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to 65° C. First-stage monomer emulsion (core) was prepared by homogenizing a monomer mixture of 239 grams of methyl methacrylate (MMA) and 39 grams of diisopropylaminoethyl methacrylate (DIAEMA) with an aqueous solution (0.6 gram of sodium dodecyl sulfate, 1 gram of TRITON X-405™, and 125 grams of deionized water at 10,000 rpm for 5 minutes at room temperature of about 25° C. by a VirTishear Cyclone Homogenizer. Second-stage monomer emulsion (shell) was prepared by homogenizing a monomer mixture of 239 grams of methyl methacrylate (MMA) and 39 grams diisopropylaminoethyl methacrylate (DIAEMA) with an aqueous solution (0.6 gram of sodium dodecyl sulfate, 1 gram of TRITON X-405™, and 125 grams of deionized water) at 10,000 rpm for 5 minutes at room temperature of about 25° C. by a VirTishear Cyclone Homogenizer. Twenty-one (21) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow seed particle formation. The remaining 384 grams of first-stage monomer emulsion were then fed continuously into the reactor over 1 hours and 30 minutes. At the conclusion of the first-stage monomer emulsion feed, the resulting batch was held at 65° C. for 10 minutes. A second-stage monomer emulsion was then fed continuously into the reactor over 3 hours and 5 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a high molecular weight core having an $M_w$ of 424,000 and a low molecular weight shell having an $M_w$, of 365,000, as determined on a Waters GPC. The resulting latex has an average mid-point Tg of 84° C., as measured on a Seiko DSC. The latex product includes both core and shell polymer. This core-shell latex resin possessed an volume average diameter of 162 nanometers, wherein the polymer core possesses an volume average diameter of 134 nanometers, as measured by light scattering technique on a Coulter N4 Plus Particle Sizer, wherein the polymer shell was estimated to have a thickness of about 14 nanometers. This core-shell latex resin possessed a thermal decomposition temperature of 258° C. as measured by thermogravimetric analysis (TGA) on a Hi-Res Auto TGA 2950. The copolymer powder of the above core-shell polymer latex was isolated by freeze drying the latex in vacuum. The resulting number median particle diameter was 183 nanometers as estimated by light scattering of a redispersed aqueous suspension on a Coulter N4 Plus Particle Sizer.

SYNTHETIC EXAMPLE V

A core-shell latex polymer comprised of a polymer core of methyl methacrylate (MMA)/diisopropylaminoethyl methacrylate (DIAEMA)/ethylene glycol dimethacrylate (EGDMA) of 84/14/2 parts in composition, and a polymer shell of methyl methacrylate (MMA)/diisopropylaminoethyl methacrylate (DIAEMA) of 86/14 parts (by weight) in composition, and an overall 50:50 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of anionic surfactant sodium dodecyl sulfate (available from Aldrich), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to about 65° C. First-stage Monomer emulsion (core) was prepared by homogenizing a monomer mixture of 234 grams of methyl methacrylate (MMA), 39 grams of diisopropylaminoethyl methacrylate (DIAEMA), and 5 grams of ethylene glycol dimethacrylate with an aqueous solution of 0.6 grams of sodium dodecyl sulfate, and 1 gram of TRITON X-405™, and 125 grams of deionized water at 10,000 rpm for 5 minutes at room temperature of about 25° C. by a VirTishear Cyclone Homogenizer. Second-stage monomer emulsion (shell) was prepared by homogenizing a monomer mixture of 239 grams of methyl methacrylate (MMA) and 39 grams diisopropylaminoethyl methacrylate (DIAEMA) with an aqueous solution (0.6 grams of sodium dodecyl sulfate, 1 gram of TRITON X-405™, and 125 grams of deionized water at 10,000 rpm for 5 minutes at room temperature of about 25° C. by a VirTishear Cyclone Homogenizer. Twenty-one (21) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow a seed particle formation. The remaining 384 grams of first-stage monomer emulsion were then fed continuously into the reactor over 2 hours and 10 minutes. At the conclusion of the first-stage monomer emulsion feed, the resulting batch was held at 65° C. for 10 minutes. A second-stage monomer emulsion was then fed continuously into the reactor over 2 hours and 20 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a high molecular weight core having an $M_w$ of 587,000 and a low molecular weight shell having an $M_w$ of 371,000, as determined on a Waters GPC. The resulting latex has an average mid-point Tg of 109° C., as measured on a Seiko DSC. The latex product includes both core and shell polymer. This core-shell latex resin possessed an volume average diameter of 135 nanometers, wherein the polymer core possesses an volume average diameter of 115 nanometers, as measured by light scattering technique on a Coulter N4 Plus Particle Sizer, wherein the polymer shell was estimated to have a thickness of about 10 nanometers. This core-shell latex resin possessed a thermal decomposition temperature of 328° C. as measured by thermogravimetric analysis (TGA) on a Hi-Res Auto TGA 2950.

The copolymer powder of the above core-shell polymer latex was isolated by freeze drying the latex in vacuum. The resulting number median particle diameter was 155 nanometers as estimated by light scattering of a redispersed aqueous suspension on a Coulter N4 Plus Particle Sizer.

SYNTHETIC EXAMPLE VI

A core-shell latex polymer comprised of a polymer core of methyl methacrylate (MMA)/diisopropylaminoethyl methacrylate (DIAEMA)/glycidyl methacrylate (GMA) of 81/14/5 parts (by weight throughout unless otherwise indicated) in composition, and a polymer shell of methyl methacrylate (MMA)/diisopropylaminoethyl methacrylate (DIAEMA) of 86/14 parts (by weight) in composition, and an overall 50:50 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of the anionic surfactant sodium dodecyl sulfate (available from Aldrich), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to 65° C. First-stage monomer emulsion (core) was prepared by homogenizing a monomer mixture of 225 grams of methyl methacrylate (MMA), 39 grams of diisopropylaminoethyl methacrylate (DIAEMA), and 14 grams of glycidyl methacrylate (GMA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Second-stage monomer emulsion (shell) was prepared by homogenizing a monomer mixture of 239 grams of methyl methacrylate (MMA) and 39 grams diisopropylaminoethyl methacrylate (DIAEMA) with an aqueous solution (0.6 grams of sodium dodecyl sulfate, 1.0 grams of TRITON X-405™, and 125 grams of deionized water) at 10,000 rpm for 5 minutes at room temperature of about 25° C. by a VirTishear Cyclone Homogenizer. Twenty-one (21) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow a seed particle formation. The remaining 384 grams of first-stage monomer emulsion were then fed continuously into the reactor over 2 hours and 10 minutes. At the conclusion of the first-stage monomer emulsion feed, the resulting batch was held at 65° C. for 10 minutes. A second-stage monomer emulsion was then fed continuously into the reactor over 2 hours and 20 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a high molecular weight core having an $M_w$ of 674,000 and a low molecular weight shell having an $M_w$ of 355,000, as determined on a Waters GPC. The resulting latex has an average mid-point Tg of 122° C., as measured on a Seiko DSC. The latex product includes both core and shell polymer. This core-shell latex resin possessed an volume average diameter of 164 nanometers, wherein the polymer core possesses an volume average diameter of 138 nanometers, as measured by light scattering technique on a Coulter N4 Plus Particle Sizer, wherein the polymer shell was estimated to have a thickness of about 13 nanometers. This core-shell latex resin possessed a thermal decomposition temperature of 347° C. as measured by thermogravimetric analysis (TGA) on a Hi-Res Auto TGA 2950.

The copolymer powder of the above core-shell polymer latex was isolated by freeze drying the latex in vacuum. The resulting number median particle diameter of the core with the shell coating throughout the Examples, was 186 nanometers as estimated by light scattering of a redispersed aqueous suspension on a Coulter N4 Plus Particle Sizer.

SYNTHETIC EXAMPLE VII

A core-shell latex polymer comprised of a polymer core of methyl methacrylate (MMA)/diisopropylaminoethyl methacrylate (DIAEMA)/diacetone acrylamide (DAA) of 82/14/4 parts (by weight throughout unless otherwise indicated) in composition, and a polymer shell of diisopropylaminoethyl methacrylate (DIAEMA) of 100 parts (by weight) in composition, and an overall 50:50 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of anionic surfactant sodium dodecyl sulfate (available from Aldrich Chemical), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to about 65° C. First-stage monomer emulsion (core) was prepared by homogenizing a monomer mixture of 228 grams of methyl methacrylate (MMA), 39 grams of diisopropylaminoethyl methacrylate (DIAEMA), and 11 grams of diacetone acrylamide (DAA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Second-stage monomer emulsion (shell) was prepared by homogenizing a monomer of 239 grams of methyl methacrylate (MMA) and 39 grams of diisopropylaminoethyl methacrylate (DIAEMA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Twenty-one (21) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow a seed particle formation. The remaining 384 grams of first-stage monomer emulsion were then fed continuously into the reactor over 2 hours and 30 minutes. At the conclusion of the first-stage monomer emulsion feed, the resulting batch was held at 65° C. for 10 minutes. A second-stage monomer emulsion was then fed continuously into the reactor over 2 hours and 10 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a high molecular weight core having an $M_w$ of 472,000 and a low molecular weight shell having an $M_w$ of 356,000, as determined on a Waters GPC. The resulting latex has an average mid-point Tg of 106° C., as measured on a Seiko DSC. The latex product includes both core and shell polymer. This core-shell latex resin possessed an volume average diameter of 205 nanometers, wherein the polymer core possesses an volume average diameter of 165 nanometers, as measured by light scattering technique on a Coulter N4 Plus Particle Sizer, wherein the polymer shell estimated to have a thickness of about 20 nanometers. This core-shell latex resin possessed a thermal decomposition temperature of 326° C. as measured by thermogravimetric analysis (TGA) on a Hi-Res Auto TGA 2950.

The copolymer powder of the above core-shell polymer latex was isolated by freeze drying the latex in vacuum. The resulting number median particle diameter was 224 nanometers as estimated by light scattering of a redispersed aqueous suspension on a Coulter N4 Plus Particle Sizer.

SYNTHETIC EXAMPLE VIII

A core-shell latex polymer comprised of a polymer core of methyl methacrylate (MMA)/diisopropylaminoethyl methacrylate (DIAEMA) of 86/14 parts in composition, and a polymer shell of methyl methacrylate (MMA)/dimethylaminoethyl methacrylate (DMAEMA) of 60/40 parts (by weight throughout) in composition, and an overall 53:47 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of anionic surfactant sodium dodecyl sulfate (available from Aldrich Chemical), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to 65° C. The first-stage monomer emulsion (core) was prepared by homogenizing a monomer mixture of 254 grams of methyl methacrylate (MMA), and 41 grams diisopropylaminoethyl methacrylate (DIAEMA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. The second-stage monomer emulsion (shell) was prepared by homogenizing a monomer mixture of 157 grams of methyl methacrylate (MMA) and 104 grams dimethylaminoethyl methacrylate (DMAEMA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Twenty-one (21) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow a seed particle formation. The remaining 400 grams of first-stage monomer emulsion were then fed continuously into the reactor over 2 hours and 15 minutes. At the conclusion of the first-stage monomer emulsion feed, the resulting batch was held at 65° C. for 10 minutes. A second-stage monomer emulsion was then fed continuously into the reactor over 2 hours and 30 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a core having an $M_w$ of 367,000 and a shell having an $M_w$ of 497,000, as determined on a Waters GPC. The resulting latex has an average mid-point Tg of 97° C., as measured on a Seiko DSC. The latex product includes both core and shell polymer. This core-shell latex resin possessed an volume average diameter of 164 nanometers, wherein the polymer core possesses an volume average diameter of 134 nanometers, as measured by light scattering technique on a Coulter N4 Plus Particle Sizer, wherein the polymer shell estimated to have a thickness of about 15 nanometers. This core-shell latex resin possessed a thermal decomposition temperature of 308° C. as measured by thermogravimetric analysis (TGA) on a Hi-Res Auto TGA 2950.

The copolymer powder of the above core-shell polymer latex was isolated by freeze drying the latex in vacuum. The resulting number median particle diameter was 182 nanometers as estimated by light scattering of a redispersed aqueous suspension on a Coulter N4 Plus Particle Sizer.

SYNTHETIC EXAMPLE IX

A core-shell latex polymer comprised of a polymer core of methyl methacrylate (MMA)/diisopropylaminoethyl methacrylate (DIAEMA) of 86/14 parts (by weight throughout unless otherwise indicated) in composition, and a polymer shell of methyl methacrylate (MMA)/t-butylaminoethyl methacrylate (tBAEMA) of 70/30 parts (by weight) in composition, and an overall 46:54 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of anionic surfactant sodium dodecyl sulfate (available from Aldrich Chemical), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to 65° C. First-stage monomer emulsion (core) was prepared by homogenizing a monomer mixture of 219 grams of methyl methacrylate (MMA) and 36 grams of diisopropylaminoethyl methacrylate (DIAEMA) with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. The second-stage monomer emulsion (shell) was prepared by homogenizing a monomer mixture of 211 grams of methyl methacrylate (MMA), and 90 grams of t-butylaminoethyl methacrylate with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Twenty-one (21) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow a seed particle formation. The remaining 361 grams of first-stage monomer emulsion were then fed continuously into the reactor over 2 hours and 10 minutes. At the conclusion of the first-stage monomer emulsion feed, the resulting batch was held at 65° C. for 10 minutes. A second-stage monomer emulsion was then fed continuously into the reactor over 2 hours and 20 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a core having an $M_w$ of 361,000 and a shell having an $M_w$ of 254,000, as determined on a Waters GPC. The resulting latex has an average mid-point Tg of 81° C., as measured on a Seiko DSC. The latex product includes both core and shell polymer. This core-shell latex resin possessed a volume average diameter of 178 nanometers, wherein the polymer core possesses an volume average diameter of 142 nanometers, as measured by light scattering technique on a Coulter N4 Plus Particle Sizer, wherein the polymer shell estimated to have a thickness of about 18 nanometers. This core-shell latex or polymer resin possessed a thermal decomposition temperature of 245° C. as measured by thermogravimetric analysis (TGA) on a Hi-Res Auto TGA 2950.

The copolymer powder of the above core-shell polymer latex was isolated by freeze drying the latex in vacuum. The resulting number median particle diameter was 196 nanometers as estimated by light scattering of a redispersed aqueous suspension on a Coulter N4 Plus Particle Sizer.

SYNTHETIC EXAMPLE X

A core-shell latex polymer comprised of a polymer core of methyl methacrylate (MMA)/diisopropylaminoethyl methacrylate (DIAEMA) of 86/14 parts (by weight throughout unless otherwise indicated) in composition, and a polymer shell of diisopropylaminoethyl methacrylate (DIAEMA)/trifluoroethyl methacrylate (TFEMA) of 90/10 parts (by weight) in composition, and an overall 50:50 weight ratio of core:shell based on the initial charge of reactants, was prepared by a semicontinuous, sequential emulsion polymerization process as follows. A 2 liter jacketed glass flask with a stirrer set at 200 rpm, and containing 2.5 grams of anionic surfactant sodium dodecyl sulfate (available from Aldrich Chemical), 3.6 grams of polyethoxylated octylphenol nonionic surfactant, TRITON X-405™ (70 percent active, available from Union Carbide), and 519 grams of deionized water was purged with nitrogen for 30 minutes while the temperature was maintained at from about 25° C. to about 65° C. The first-stage monomer emulsion (core) was prepared by homogenizing a monomer mixture of 239 grams of methyl methacrylate (MMA), and 39 grams of diisopropylaminoethyl methacrylate (DIAEMA), with an aqueous solution (0.6 grams of sodium dodecyl sulfate, 1 gram of TRITON X-405™, and 125 grams of deionized water) at 10,000 rpm for 5 minutes at room temperature of about 25° C. by a VirTishear Cyclone Homogenizer. Second-stage monomer emulsion (shell) or coating was prepared by homogenizing a monomer mixture of 250 grams diisopropylaminoethyl methacrylate (DIAEMA) and 28 grams of trifluoroethyl methacrylate (TFEMA) with an aqueous solution (0.6 gram of sodium dodecyl sulfate, 1 gram of TRITON X-405™, and 125 grams of deionized water) at 10,000 rpm for 5 minutes at room temperature of about 25° C. by a VirTishear Cyclone Homogenizer. Twenty-one (21) grams of seed was removed from the first-stage monomer emulsion and added into the flask, and the flask contents were stirred for 5 minutes at 65° C. An initiator solution prepared from 3.3 grams of ammonium persulfate in 40 grams of deionized water was added to the flask mixture over 20 minutes. Stirring continued for an additional 20 minutes to allow a seed particle formation. The remaining 384 grams of first-stage monomer emulsion were then fed continuously into the reactor over 2 hours and 10 minutes. At the conclusion of the first-stage monomer emulsion feed, the resulting batch was held at 65° C. for 10 minutes. A second-stage monomer emulsion was then fed continuously into the reactor over 2 hours and 20 minutes. The nitrogen purge was reduced to a slow trickle to maintain a small positive pressure. After the above second-stage monomer emulsion addition was completed, the reaction was allowed to post react for 120 minutes at 65° C., then cooled to 25° C. by cold water. The resulting core-shell latex polymer possessed a bimodal molecular weight distribution, with a low molecular weight core having an $M_w$ of 354,000 and a high molecular weight shell having an $M_w$ of 681,000, as determined on a Waters GPC. The resulting latex has an average mid-point Tg of 117° C., as measured on a Seiko DSC. The latex product includes both core and shell polymer. This core-shell latex resin possessed an volume average diameter of 127 nanometers, wherein the polymer core possesses an volume average diameter of 107 nanometers, as measured by light scattering technique on a Coulter N4 Plus Particle Sizer, wherein the polymer shell was estimated to have a thickness of about 10 nanometers. This core-shell latex resin possessed a thermal decomposition temperature of 328° C. as measured by thermogravimetric analysis (TGA) on a Hi-Res Auto TGA 2950.

The copolymer powder of the above core-shell polymer latex was isolated by freeze drying the latex in vacuum. The resulting number median particle diameter was 135 nanometers as estimated by light scattering of a redispersed aqueous suspension on a Coulter N4 Plus Particle Sizer.

CARRIER EXAMPLE I

In the first step of the carrier coating process, 22.46 grams of the core-shell copolymer comprised of a polymer core of methyl methacrylate (MMA)/diisopropylaminoethyl methacrylate (DIAEMA) of 98/2 parts (by weight) in composition, and a polymer shell of methyl methacrylate (MMA)/diisopropylaminoethyl methacrylate (DIAEMA) of 86/14 parts (by weight) in composition, and an overall 50:50 weight ratio of core:shell, generated with a particle size of 185 nanometers prepared via the semicontinuous, sequential emulsion polymerization of Synthetic Example I, and 2,266 grams of 65 micron volume median diameter irregular steel core (obtained from Hoeganaes), with the core size determined in this and all following carrier Examples by a standard laser diffraction technique, were mixed. Prior to mixing with the core, the prepared core polymer shell was ground to 7.3 microns in an 0202 Jet-O-Mizer (Fluid Energy Aljet) using a feed pressure of 105 psi and a feed rate of 0.6 gram per minute. The mixing was accomplished in a V-Cone blender at a blender speed of 23.5 rotations per minute and a blend time of 30 minutes. There resulted uniformly distributed and electrostatically attached polymer on the core as determined by visual observation. In the second step, the resulting carrier particles were inserted into a rotating tube furnace for a period of 30 minutes. This furnace was maintained at a temperature of 350° F. thereby causing the polymer to melt and fuse to the core. This resulted in a continuous uniform polymer coating on the core. The product from the kiln was screened through an 84 TBC (Tensile Bolt Cloth) mesh screen to remove any large agglomerates. The final product was comprised of a carrier core with a total of 1 percent (weight percent throughout) core copolymer (of poly(MMA-co-DIAEMA) (98 percent/2 percent monomer ratio), shell polymer of poly(MMA-co-DIAEMA) (86 percent/14 percent monomer ratio), and core:shell weight ratio of 50:50) by weight on the surface. The weight percent of the core-shell copolymer on the carrier core was determined in this and all following carrier Examples by dividing the difference between the weights of the fused carrier and the carrier core by the weight of the fused carrier.

A developer composition was then prepared by mixing 200 grams of the above prepared carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer. Thereafter, the triboelectric charge on the carrier particles was determined by the known Faraday Cage process, and there was measured on the carrier a positive charge of 62 microcoulombs per gram. Further, the conductivity of the carrier as determined by forming a 0.1 inch long magnetic brush of the carrier particles, and measuring the conductivity by imposing a 10 volt potential across the brush was $2.3\times10^{-10}$ (mho-cm)$^{-1}$. Therefore, these carrier particles were semiconductive.

CARRIER EXAMPLE II

In the first step of the carrier coating process, 22.46 grams of the core-shell copolymer comprised of a polymer core of methyl methacrylate (MMA)/diisopropylaminoethyl methacrylate (DIAEMA) of 98/2 parts (by weight) in composition, and a polymer shell of methyl methacrylate (MMA)/diisopropylaminoethyl methacrylate (DIAEMA) of 86/14 parts (by weight) in composition, and an overall 10:90 weight ratio of core:shell, generated with a particle size of 195 nanometers prepared by the semicontinuous, sequential emulsion polymerization of Synthetic Example II, and 2,266 grams of 65 micron volume median diameter irregular steel core (obtained from Hoeganaes) were mixed. The conditions under which the carrier was processed are the same as that of Carrier Example I. The final product was comprised of the above steel carrier core with a total of 1 percent core-shell copolymer; with a core polymer of poly(MMA-co-DIAEMA) (98 percent/2 percent monomer ratio), a shell polymer of poly(MMA-co-DIAEMA) (86 percent/14 percent monomer ratio), and core:shell weight ratio of 10:90 by weight on the surface of the steel core.

A developer composition was then prepared in the same manner as Carrier Example I. Thereafter, the triboelectric charge on the carrier particles was determined by the known Faraday Cage process, and there was measured on the carrier a charge of 29 microcoulombs per gram. Further, the conductivity of the carrier as determined by forming a 0.1 inch long magnetic brush of the carrier particles, and measuring the conductivity by imposing a 10 volt potential across the brush was $1.8\times10^{-13}$ (mho-cm)$^{-1}$. Therefore, these carrier particles were insulative.

CARRIER EXAMPLE III 22.46 Grams of the core-shell copolymer comprised of a polymer core of methyl methacrylate (MMA)/diisopropylaminoethyl methacrylate (DIAEMA) of 98/2 parts (by weight) in composition, and a polymer shell of methyl methacrylate (MMA)/diisopropylaminoethyl methacrylate (DIAEMA) of 86/14 parts (by weight) in composition, and an overall 90:10 weight ratio of core:shell, generated with a particle size of 177 nanometers and prepared by the semicontinuous, sequential emulsion polymerization of Synthetic Example III, and 2,266 grams of 65 micron volume median diameter irregular steel core (obtained from Hoeganaes) were mixed. The conditions under which the carrier was processed are the same as, or similar to that of Carrier Example I. The final product was comprised of a carrier core with a total of 1 percent core-shell copolymer, a core polymer of poly(MMA-co-DIAEMA) (98 percent/2 percent monomer ratio), a shell polymer of poly(MMA-co-DIAEMA) (86 percent/14 percent monomer ratio), and core:shell weight ratio of 90:10 by weight on the surface.

A developer composition was then prepared in the same manner as Carrier Example I. Thereafter, the triboelectric charge on the carrier particles was determined by the known Faraday Cage process, and there was measured on the carrier a charge of 75 microcoulombs per gram. Further, the conductivity of the carrier as determined by forming a 0.1 inch long magnetic brush of the carrier particles, and measuring the conductivity by imposing a 10 volt potential across the brush was $8.7\times10^{-10}$ (mho-cm)$^{-1}$. Therefore, these carrier particles were semiconductive.

CARRIER EXAMPLE IV 22.46 Grams of the core-shell copolymer comprised of a polymer core of methyl methacrylate (MMA)/diisopropylaminoethyl methacrylate (DIAEMA) of 86/14 parts (by weight) in composition, and a polymer shell of methyl methacrylate (MMA)/diisopropylaminoethyl methacrylate (DIAEMA) of 86/14 parts (by weight) in composition, and an overall 50:50 weight ratio of core:shell, generated with a particle size of 183 nanometers and prepared by the semicontinuous, sequential emulsion polymerization of Synthetic Example IV, and 2,266 grams of 65 micron volume median diameter irregular steel core (obtained from Hoeganaes) were mixed. The conditions under which the carrier was processed were similar to that of Carrier Example I. The final product was comprised of a carrier core with a total of 1.0 percent core-shell copolymer (of core polymer of poly(MMA-co-DIAEMA) (86 percent/14 percent monomer ratio), shell polymer of poly(MMA-co-DIAEMA) (86 percent/14 percent monomer ratio), and a core:shell weight ratio of 50:50) by weight on the surface.

A developer composition was then prepared in the same manner as Carrier Example I. Thereafter, the triboelectric charge on the carrier particles was determined by the known Faraday Cage process, and there was measured on the carrier a charge of 91 microcoulombs per gram. Further, the conductivity of the carrier as determined by forming a 0.1 inch long magnetic brush of the carrier particles, and measuring the conductivity by imposing a 10 volt potential across the brush was $8.1\times10^{-9}$ (mho-cm)$^{-1}$. Therefore, these carrier particles were conductive.

CARRIER EXAMPLE V 22.46 Grams of the core-shell copolymer comprised of a polymer core of methyl methacrylate (MMA)/diisopropylaminoethyl methacrylate (DIAEMA)/ethylene glycol dimethacrylate (EGDMA) of 84/14/2 parts (by weight) in composition, and a polymer shell of methyl methacrylate (MMA)/diisopropylaminoethyl methacrylate (DIAEMA) of 86/14 parts (by weight) in composition, and an overall 50:50 weight ratio of core:shell, generated with a particle size of 155 nanometers and prepared by the semicontinuous, sequential emulsion polymerization of Synthetic Example V, and 2,266 grams of 65 micron volume median diameter irregular steel core (obtained from Hoeganaes) were mixed. The conditions under which the carrier was processed were the same as that of Carrier Example I. The final carrier product was comprised of a carrier core with a total of 1 percent coreshell copolymer (core polymer of poly(MMA-co-DIAEMA-co-EGDMA) (84 percent/14 percent/2 percent monomer ratio), shell polymer of poly(MMA-co-DIAEMA) (86 percent/14 percent monomer ratio), and core:shell weight ratio of 50:50)by weight on the surface.

A developer composition was then prepared in the same manner as Carrier Example I. Thereafter, the triboelectric charge on the carrier particles was determined by the known Faraday Cage process, and there was measured on the carrier a charge of 45 microcoulombs per gram. Further, the conductivity of the carrier as determined by forming a 0.1 inch long magnetic brush of the carrier particles, and measuring the conductivity by imposing a 10 volt potential across the brush was $7.8\times10^{-11}$ (mho-cm)$^{-1}$. Therefore, these carrier particles were semiconductive.

CARRIER EXAMPLE VI 22.46 Grams of the core-shell copolymer comprised of a polymer core of methyl methacrylate (MMA)/diisopropylaminoethyl methacrylate (DIAEMA)/glycidyl methacrylate (GMA) of 81/14/5 parts (by weight) in composition, and a polymer shell of methyl methacrylate (MMA)/diisopropylaminoethyl methacrylate (DIAEMA) of 86/14 parts (by weight) in composition, and an overall 50:50 weight ratio of core:shell, generated with a particle size of 186 nanometers and prepared by the semicontinuous, sequential emulsion polymerization of Synthetic Example VI, and 2,266 grams of 65 micron volume median diameter irregular steel core (obtained from Hoeganaes) were mixed. The conditions under which the carrier was processed were the same as that of Carrier Example I. The final product was comprised of a carrier core with a total of 1 percent core-shell copolymer (core polymer of poly(MMA-co-DIAEMA-co-GMA) (81 percent/14 percent/5 percent monomer ratio), shell polymer of poly(MMA-co-DIAEMA) (86 percent/14 percent monomer ratio), and core:shell weight ratio of 50:50) by weight on the surface.

A developer composition was then prepared in the same manner as Carrier Example I. Thereafter, the triboelectric charge on the carrier particles was determined by the known Faraday Cage process, and there was measured on the carrier a charge of 34 microcoulombs per gram. Further, the conductivity of the carrier as determined by forming a 0.1 inch long magnetic brush of the carrier particles, and measuring the conductivity by imposing a 10 volt potential across the brush was $3.2\times10^{-12}$ (mho-cm)$^{-1}$. Therefore, these carrier particles were semiconductive.

CARRIER EXAMPLE VII 22.46 Grams of the core-shell copolymer comprised of a polymer core of methyl methacrylate (MMA)/diisopropylaminoethyl methacrylate (DIAEMA)/diacetone acrylamide (DAA) of 82/14/4 parts (by weight) in composition, and a polymer shell of methyl methacrylate (MMA)/diisopropylaminoethyl methacrylate (DIAEMA) of 86/14 parts (by weight) in composition, and an overall 50:50 weight ratio of core:shell, generated with a particle size of 224 nanometers prepared via a semicontinuous, sequential emulsion polymerization in Synthetic Example VII, and 2,266 grams of 70 micron volume median diameter irregular steel core (obtained from Hoeganaes) were mixed. The conditions under which the carrier was processed were the same as that of Carrier Example I. The carrier final product was comprised of the above carrier core with a total of 1 percent core-shell copolymer thereover (core polymer of poly(MMA-co-DIAEMA-co-DAA) (82 percent/14 percent/4 percent monomer ratio), shell polymer of poly (MMA-co-DIAEMA) (86 percent/14 percent monomer ratio), and core:shell weight ratio of 50:50) by weight on the surface of the above steel core.

A developer composition was then prepared in the same manner as Carrier Example I. Thereafter, the triboelectric charge on the carrier particles was determined by the known Faraday Cage process, and there was measured on the carrier a charge of 66 microcoulombs per gram. Further, the conductivity of the carrier as determined by forming a 0.1 inch long magnetic brush of the carrier particles, and measuring the conductivity by imposing a 10 volt potential across the brush was $3.4\times10^{-9}$ (mho-cm)$^{-1}$. Therefore, these carrier particles were conductive.

CARRIER EXAMPLE VIII 22.46 Grams of the core-shell copolymer comprised of a polymer core of methyl methacrylate (MMA)/diisopropylaminoethyl methacrylate (DIAEMA) of 86/14 parts (by weight) in composition, and a polymer shell of methyl methacrylate (MMA)/dimethylaminoethyl methacrylate (DMAEMA) of 60/40 parts (by weight) in composition, and an overall 53:47 weight ratio of core:shell, generated with a particle size of 182 nanometers prepared by the semicontinuous, sequential emulsion polymerization of Synthetic Example VII, and 2,266 grams of 65 micron volume median diameter irregular steel core (obtained from Hoeganaes) were mixed. The conditions under which the carrier was processed were the same as that of Carrier Example I. The carrier final product was comprised of the above steel carrier core with a total coating thereover of 1 percent core-shell copolymer (core polymer of poly(MMA-co-DIAEMA) (86 percent/14 percent monomer ratio), shell polymer of poly(MMA-co-DMAEMA) (60 percent/40 percent monomer ratio), and core:shell weight ratio of 53:47) by weight on the surface.

A developer composition was then prepared in the same manner as Carrier Example I. Thereafter, the triboelectric charge on the carrier particles was determined by the known Faraday Cage process, and there was measured on the carrier a charge of 87 microcoulombs per gram. Further, the conductivity of the carrier as determined by forming a 0.1 inch long magnetic brush of the carrier particles, and measuring the conductivity by imposing a 10 volt potential across the brush was $4.8\times10^{-9}$ (mho-cm)$^{-1}$. Therefore, these carrier particles were conductive.

CARRIER EXAMPLE IX 22.46 Grams of the core-shell copolymer comprised of a polymer core of methyl methacrylate (MMA)/diisopropylaminoethyl methacrylate (DIAEMA) of 86/14 parts (by weight) in composition, and a polymer shell of methyl methacrylate (MMA)/t-butylaminoethyl methacrylate (tBAEMA) of 70/30 parts (by weight) in composition, and an overall 46:54 weight ratio of core:shell, generated with a particle size of 196 nanometers and prepared by the semicontinuous, sequential emulsion polymerization of Synthetic Example IX, and 2,266 grams of 65 micron volume median diameter irregular steel core (obtained from Hoeganaes) were mixed. The conditions under which the carrier was processed were substantially identical to that of Carrier Example I. The final carrier product was comprised of a carrier core with a total of 1.0 percent core-shell copolymer [core polymer of poly(MMA-co-DIAEMA) (86 percent/14 percent monomer ratio), shell polymer of poly (MMA-co-tBAEMA) (70 percent/30 percent monomer ratio), and core:shell weight ratio of 46:54] by weight on the surface.

A developer composition was then prepared in the same manner as Carrier Example I. Thereafter, the triboelectric charge on the carrier particles was determined by the known Faraday Cage process, and there was measured on the carrier a charge of 43 microcoulombs per gram. Further, the conductivity of the carrier as determined by forming a 0.1 inch long magnetic brush of the carrier particles, and measuring the conductivity by imposing a 10 volt potential across the brush was $1.0\times10^{-14}$ (mho-cm)$^{-1}$. Therefore, these carrier particles were insulative.

The carrier in embodiments, reference carrier Example IX and X, and others is comprised of a polymer core with a shell thereover, and a carrier core, like a steel core containing the coating of the polymer corepolymer shell.

CARRIER EXAMPLE X 22.46 Grams of the core-shell copolymer comprised of a polymer core of methyl methacrylate (MMA)/diisopropylaminoethyl methacrylate (DIAEMA) of 86/14 parts (by weight) in composition, and a polymer shell of methyl methacrylate (MMA)/trifluoroethyl methacrylate (TFEMA) of 90/10 parts (by weight) in composition, and an overall 50:50 weight ratio of core:shell, generated with a particle size of 135 nanometers and prepared by the semicontinuous, sequential emulsion polymerization of Synthetic Example X, and 2,266 grams of 65 micron volume median diameter irregular steel core (obtained from Hoeganaes) were mixed. The conditions under which the carrier was processed are substantially identical to that of Carrier Example I. The final product was comprised of a steel carrier core with a total thereover of 1.0 percent core-shell copolymer [core polymer of poly(MMA-co-DIAEMA) (86 percent/14 percent monomer ratio), shell polymer of poly(MMA-co-TFEMA) (90 percent/10 percent monomer ratio), and core:shell weight ratio of 50:50] by weight on the surface.

A developer composition was then prepared in the same manner as Carrier Example I. Thereafter, the triboelectric charge on the carrier particles was determined by the known Faraday Cage process, and there was measured on the carrier a charge of 102 microcoulombs per gram. Further, the conductivity of the carrier as determined by forming a 0.1 inch long magnetic brush of the carrier particles, and measuring the conductivity by imposing a 10 volt potential across the brush was $1.2\times10^{-13}$ (mho-cm)$^{-1}$. Therefore, these carrier particles were insulative.

In embodiments, and as illustrated herein, the carrier core can be comprised of a carrier core, like steel, ferrite, and the like, with a polymer core thereover, and a polymer shell thereof, or wherein the polymer shell may encapsulate the carrier core and core polymer.

Other modifications of the present invention may occur to those skilled in the art subsequent to a review of the present application and these modifications, including equivalents thereof, substantial equivalents, similar equivalents and the like, are intended to be included within the scope of the present invention.

What is claimed is:

1. A process for the preparation of a coated carrier wherein the coating is generated from a latex monomer comprising (A)

(i) emulsification and heating of monomer, chain transfer agent, water, surfactant, and initiator;

(ii) generating a seed latex by the aqueous emulsion polymerization of a mixture comprised of part of the (i) monomer emulsion, which part is from about 0.5 to about 50 percent by weight, and an optional free radical initiator, and which polymerization is accomplished by (iii) heating and adding to the formed seed particles of (ii) the remaining monomer emulsion of (i), from about 50 to about 99.5 percent by weight of monomer emulsion of (i) and free radical initiator;

(iv) to provide a carrier core polymer; and (B) forming a shell thereover said core generated polymer and which shell is generated by emulsion polymerization of a second monomer in the presence of said core polymer (iv), which emulsion polymerization is accomplished by (i) emulsification and heating of monomer, chain transfer agent, surfactant, and initiator;

(ii) adding a free radical initiator and heating;

(iii) to provide said shell polymer and admixing and heating with a carrier core.

2. A process in accordance with claim 1 and comprising generating (A) core polymer from an aqueous latex containing water and a monomer, and wherein said polymer possesses a glass transition temperature (Tg) of from about 20° C. to about 50° C., and a weight average molecular weight ($M_w$) of from about 5,000 to about 30,000, which latex is generated by the emulsion polymerization of a first core monomer by (i) emulsification of the polymerization components of monomer, chain transfer agent, water, surfactant, and initiator, and wherein the emulsification is accomplished at a low temperature of from about 5° C. to about 40° C.;

(ii) generating a seed latex by the aqueous emulsion polymerization of a mixture comprised of part of the monomer emulsion (i), which part is from about 0.5 to about 50 percent by weight, and a free radical initiator, from about 0.5 to about 100 percent by weight of total initiator used to prepare the core polymer resin, and which polymerization is accomplished at a temperature of from about 35° C. to about 125° C. and wherein the reaction of the free radical initiator and monomer generates a seed latex containing a polymer;

(iii) heating and adding to the formed seed particles of (ii) the remaining monomer emulsion of (i), from about 50 to about 99.5 percent by weight of monomer emulsion of (i) and a free radical initiator, from about 0.5 to about 99.5 percent by weight of total initiator used to prepare the polymer resin and which heating is at a temperature of from about 35° C. to about 125° C.; and (iv) retaining the above mixture of (iii) at a temperature of from about 35° C. to about 125° C. to provide a core polymer, and wherein said core polymer possesses a glass transition temperature (Tg) of from about 20° C. to about 50° C., and a weight average molecular weight ($M_w$) of from about 5,000 to about 30,000; and (B) forming a shell thereover said core generated polymer and which shell is generated by emulsion polymerization of a second monomer by polymerizing said second monomer with a glass transition temperature of from about 50° C. to about 70° C., and a weight average molecular weight of from about 30,000 to about 100,000, and which emulsion polymerization is accomplished by (i) emulsification polymerization of monomer, chain transfer agent, surfactant, and an initiator, and wherein said polymerization is accomplished at a low temperature of from about 5° C. to about 40° C.;

(ii) adding a free radical initiator, from about 0.1 to about 99.5 percent by weight, and heating at a temperature of from about 35° C. to about 125° C.; and (iii) retaining the resulting core-shell polymer colloid dispersed in water at a temperature of from about 35° C. to about 125° C., followed by cooling and wherein in the resulting core-shell polymer latex, the core-shell polymer is present in an amount of from about 5 to about 60 percent by weight, the water is present in an amount of from about 40 to about 94 percent by weight, the surfactant is present in an amount of from about 0.01 to about 10 percent by weight, and wherein said polymer core possesses a glass transition temperature (Tg) of from about 20° C. to about 50° C., and a weight average molecular weight ($M_w$) of from about 5,000 to about 30,000, said polymer shell possessing a glass transition temperature of about 50° C. to about 70° C., and a weight average molecular weight of from about 30,000 to about 100,000, and optionally wherein the polymer shell possesses a thickness of about 0.01 microns to about 0.3 microns, and wherein said resulting core and said shell polymer are admixed and heated to fuse said components to a nonpolymeric carrier core.

3. A process in accordance with claim 2 wherein said core polymer possesses a glass transition temperature (Tg) of from about 30° C. to about 50° C., and a weight average molecular weight ($M_w$) of from about 8,000 to about 25,000, and said core latex contains from about 50 to about 90 percent by weight of water, and from about 65 to about 95 of surfactant, wherein said (ii) seed particle latex contains from about 3 to about 25 percent by weight of the emulsion (A) (i); adding to the core monomer emulsion in (ii) said free radical initiator in an amount of from about 3 to about 100 percent by weight of total initiator used to prepare the core polymer resin; (iv) heating and feed adding to the formed core seed particles of (iii) the remaining monomer emulsion from about 75 to about 97 percent by weight of monomer emulsion in (B) (ii) and free radical initiator from about 0.5 to about 97 percent by weight of total initiator and retaining said mixture at a temperature of from about 35° C. to about 125° C. for from about 0.1 to about 10 hours.

4. A process in accordance with claim 1 wherein said heating (iii) is at a temperature which causes said core and said coating to fuse together.

5. A process in accordance with claim 4 wherein said heating is at a temperature of from about 400° C. to about 700° C.

6. A process in accordance with claim 1 wherein said core-shell latex surfactant is selected in an amount of from about 0.05 to about 10 weight percent based on the total amount of monomers used to prepare the core-shell latex polymer.

7. A process in accordance with claim 1 wherein said carrier core is a ferrite.

8. A process in accordance with claim 1 wherein said carrier core is iron, steel, or mixtures thereof.

9. A process in accordance with claim 1 wherein the coating carrier coverage for said core is from about 90 to about 100 percent.

10. A process in accordance with claim 1 wherein the coating shell coverage for said carrier core is from about 80 to about 98 percent.

11. A process in accordance with claim 1 wherein the size diameter of said carrier core is from about 25 to about 125 microns.

12. A process in accordance with claim 1 wherein said core polymer is poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly (alkyl methacrylate-alkyl acrylate), poly(alkyl methacrylate-aryl acrylate-acrylic acid), poly(alkyl methacrylate-acrylic acid), poly(styrene-alkyl acrylate-acrylonitrile-acrylic acid), poly(styrene-1,3-diene-acrylonitrile-acrylic acid), and poly (alkyl acrylate-acrylonitrile-acrylic acid), and a shell polymer of poly(styrene-butadiene), poly(alkyl methacrylate-butadiene), poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate-acrylic acid), poly(styrene-butadiene-acrylic acid), poly(alkyl acrylate-butadiene-acrylic acid), poly(alkyl methacrylate-butadiene-acrylic acid), poly(alkyl methacrylate-acrylic acid), poly(styrene-alkyl acrylate-acrylonitrile-acrylic acid), poly(styrene-1,3-diene-acrylonitrile-acrylic acid), or poly(alkyl acrylate-acrylonitrile-acrylic acid), and wherein said core polymer is present in an amount of from about 10 to about 60 weight percent, or parts, and wherein said shell polymer thereover is present in an amount of from about 40 to about 90 weight percent or parts.

13. A process in accordance with claim 1 wherein said core polymer (iv) is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(styrene-isoprene), poly(methyl methacrylate-isoprene), poly(ethyl methacrylate-isoprene), poly(propyl methacrylate-isoprene), poly(butyl methacrylate-isoprene), poly(styrene-propyl acrylate), poly (styrene-butyl acrylate), poly(styrene-2-ethylhexyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly (styrene-butyl acrylate-acrylononitrile), poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly(methyl methacrylate-butadiene-methacrylic acid), poly(methyl methacrylate-butadiene-acrylonitrile-acrylic acid), poly(methyl methacrylate-butyl acrylate-acrylic acid), poly(methyl methacrylate-butyl acrylate-methacrylic acid), poly(methyl methacrylate-butyl acrylate-acrylononitrile), and poly(styrene-butyl acrylate-acrylononitrile-acrylic acid); and wherein said shell polymer is selected from the group consisting of poly(styrene-butadiene), poly(methyl methacrylate-butadiene), poly (styrene-isoprene), poly(methyl methacrylate-isoprene), poly(ethyl methacrylate-isoprene), poly(butyl methacrylate-isoprene), poly(styrene-propyl acrylate), poly(styrene-butyl acrylate), poly(styrene-2-ethylhexyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-2-ethylhexyl acrylate-acrylic acid), poly(styrene-butyl acrylate-methacrylic acid), poly(styrene-2-ethylhexyl acrylate-methacrylic acid), poly(styrene-butyl acrylate-acrylononitrile), and poly(styrene-butyl acrylate-acrylononitrile-acrylic acid), poly(methyl methacrylate-propyl acrylate), poly(methyl methacrylate-butyl acrylate), poly(methyl methacrylate-butadiene-acrylic acid), poly (methyl methacrylate-butadiene-methacrylic acid), poly (methyl methacrylate-butadiene-acrylonitrile-acrylic acid), poly(methyl methacrylate-butyl acrylate-acrylic acid), poly (methyl methacrylate-butyl acrylate-methacrylic acid), poly (methyl methacrylate-butyl acrylate-acrylononitrile), and poly(styrene-butyl acrylate-acrylononitrile-acrylic acid).

14. A process in accordance with claim 1 wherein said surfactant (A) (i) and (B) (i) is an anionic surfactant selected from the group consisting of sodium dodecyl sulfate, sodium dodecylbenzene sulfate, sodium dodecylnaphthalene sulfate, and sodium tetrapropyl diphenyloxide disulfonate.

15. A process in accordance with claim 1 wherein the shell thickness is from about 2 to about 60 nanometers.

16. A process in accordance with claim 1 wherein the shell thickness is from about 5 to about 45 nanometers.

17. A process in accordance with claim 1 wherein said carrier core polymer is butadiene, isoprene, (meth)acrylate esters, or acrylonitrile, (meth)acrylic acid, and wherein said polymer possesses a glass transition temperature (Tg) of from about 20° C. to about 50° C., and a weight average molecular weight ($M_w$) of from about 5,000 to about 30,000, and which polymer is present in an amount of from about 5 to about 50, and said water is present in an amount of from about 50 to about 94 and wherein said latex is generated by the emulsion polymerization of a first core monomer by (i) emulsification of the polymerization reagents of monomer, chain transfer agent, water, surfactant, and initiator, and wherein the emulsification is accomplished at a low temperature of from about 5° C. to about 45° C.;

(ii) generating a seed latex by the aqueous emulsion polymerization of a mixture comprised of from about 0.5 to about 50 percent by weight of the (i) monomer emulsion, and a free radical initiator, from about 0.5 to about 100 percent by weight of total initiator selected to prepare the core polymer resin, and which polymerization is accomplished at a temperature of from about 35° C. to about 125° C., and wherein the reaction of the free radical initiator and monomer generates a seed latex;

(iii) heating and adding to the formed seed particles of (ii) the remaining monomer emulsion, from about 50 to about 99.5 percent by weight of monomer emulsion of (i) and free radical initiator, from about 0.5 to about 99.5 percent by weight of total initiator used to prepare the polymer resin, and which heating is at a temperature from from about 35° C. to about 125° C.; and (iv) retaining the above mixture of (iii) at a temperature of from about 35° C. to about 125° C. to provide said core polymer comprised of styrene, butadiene, isoprene, (meth)acrylates esters, or acrylonitrile, (meth)acrylic acid, and wherein said core polymer possesses a glass transition temperature (Tg) of from about 20° C. to about 50° C., and a weight average molecular weight ($M_w$) of from about 5,000 to about 30,000; and (B) forming a shell thereover said core generated polymer and which shell is generated by emulsion polymerization of a second monomer in the presence of the core by polymerizing a second monomer with a glass transition temperature of from about 50° C. to about 70° C., and a weight average molecular weight of from about 30,000 to about 100,000, which emulsion polymerization is accomplished by (i) emulsification of the polymerization reagents of monomer, chain transfer agent, surfactant, and an initiator, and wherein said emulsification is accomplished at a low temperature of from about 5° C. to about 40° C.;

(ii) adding said free radical initiator in an amount of from about 1 to about 99.5 percent by weight at a temperature from about 35° C. to about 125° C.; and (iii) retaining the resulting core-shell polymer colloid dispersed in water at a temperature of from about 35° C. to about 125° C. for a period of from about 0.5 to about 6 hours, followed by cooling and wherein in the resulting core-shell polymer latex, the core-shell polymer is present in an amount of from about 5 to about 60 percent by weight, the water is present in an amount of from about 40 to about 94 percent by weight, the surfactant is present in an amount of from about 0.01 to about 10 percent by weight, and residual initiator and chain transfer agents and fragments thereof are present in an amount of from about 0.01 to about 5 percent by weight of the total emulsion polymerization mixture, said polymer core possessing a glass transition temperature (Tg) of from about 20° C. to about 50° C., and a weight average molecular weight ($M_w$) of from about 5,000 to about 30,000, said polymer shell possessing a glass transition temperature of from about 50° C. to about 70° C., and a weight average molecular weight of from about 30,000 to about 100,000, wherein the polymer shell possesses a thickness of from about 0.01 micron to about 0.3 micron, and wherein the latex formed is comprised of a core of a polymer comprising styrene, butadiene, isoprene, (meth) acrylates esters, acrylonitrile, a (meth)acrylic acid, and a shell thereover of a polymer comprising styrene, (meth)acrylates esters, acrylonitrile, or (meth)acrylic acid.

18. A process in accordance with claim 1 wherein the core polymer and shell polymer are dissimilar.

19. The coated carrier obtained by the process of claim 1.

20. A carrier with a coating thereover and which coating is comprised of a polymer comprised of a polymer core and a polymer shell; or which coating is comprised of a shell polymer encapsulating said core polymer.

21. A carrier in accordance with claim 20 wherein the core polymer and shell polymer are dissimilar.

22. A carrier in accordance with claim 20 wherein the coating is prepared from a latex comprising a core polymer and a shell thereover, and wherein said core polymer is generated by (A)

(i) emulsification and heating of monomer, chain transfer agent, water, surfactant, and initiator;

(ii) generating a seed latex by the aqueous emulsion polymerization of a mixture comprised of part of the (i) monomer emulsion, which part is from about 0.5 to about 50 percent by weight, and a free radical initiator, and which polymerization is accomplished by heating;

(iii) heating and adding to the formed seed particles of (ii) the remaining monomer emulsion of (i), from about 50 to about 99.5 percent by weight of monomer emulsion of (i) and free radical initiator;

(iv) whereby there is provided said core polymer; and (B) forming a shell thereover said core generated polymer and which shell is generated by emulsion polymerization of a second monomer in the presence of the core polymer, which emulsion polymerization is accomplished by (i) emulsification and heating of monomer, chain transfer agent, surfactant, and an initiator;

(ii) adding a free radical initiator and heating;

(iii) whereby there is provided said shell polymer and wherein said core polymer and said shell polymer are admixed and heated with a carrier core.

23. A carrier in accordance with claim 21 wherein the carrier coating is prepared from a latex comprising a core polymer and a shell thereover and wherein said core polymer is generated by (A)

(i) emulsification and heating of monomer, chain transfer agent, water, surfactant, and initiator;

(ii) generating a seed latex by the aqueous emulsion polymerization of a mixture comprised of part of the (i) monomer emulsion, which part is from about 0.5 to about 50 percent by weight, and an optional free radical initiator, and which polymerization is accomplished by heating;

(iii) heating and adding to the formed seed particles of (ii) the remaining monomer emulsion of (i), from about 50 to about 99.5 percent by weight of monomer emulsion of (i) and free radical initiator;

(iv) whereby there is provided said core polymer; and (B) forming a shell thereover said core generated polymer and which shell is generated by emulsion polymerization of a second monomer in the presence of the core polymer, which emulsion polymerization is accomplished by (i) emulsification and heating of monomer, chain transfer agent, surfactant, and an initiator;

(ii) adding a free radical initiator and heating; and (iii) mixing with a carrier core.

24. A developer comprised of carrier of claim 20 and toner.

25. A developer in accordance with claim 24 wherein the toner is comprised of thermoplastic resin and colorant.

26. A process in accordance with claim 1 wherein said chain transfer agent or component is dodecanethiol, carbon tetrabromide or octane thiol, and wherein said initiator is an ammonium sulfate, a potassium persulfate, or a peroxide, and the surfactant is an ionic surfactant.

27. A process in accordance with claim 1 wherein said polymer shell encapsulates said polymer core and said carrier core, and wherein said carrier core is comprised of a nonpolymeric component.

28. A process which comprises mixing a carrier core with a polymer core and polymer shell and wherein the polymer shell is present as a coating on said core and said polymer core, wherein said polymer core is generated by emulsification of and heating of monomer forming a seed latex; adding a portion of said seed latex to said emulsification mixture, followed by heating and adding another second portion of said seed latex; and wherein said shell is generated by emulsion polymerization of a monomer, followed by heating.

29. A process for the preparation of a coated carrier wherein the coating is generated from a latex monomer consisting essentially of (A)

(i) emulsification and heating of monomer, chain transfer agent, water, surfactant, and initiator;

(ii) generating a seed latex by the aqueous emulsion polymerization of a mixture comprised of part of the (i) monomer emulsion, which part is from about 0.5 to about 50 percent by weight, and an optional free radical initiator, and which polymerization is accomplished by (iii) heating and adding to the formed seed particles of (ii) the remaining monomer emulsion of (i), from about 50 to about 99.5 percent by weight of monomer emulsion of (I) and free radical initiator;

(iv) to provide a carrier core polymer; and (B) forming a shell thereover said core generated polymer and which shell is generated by emulsion polymerization of a second monomer in the presence of said core polymer (iv), which emulsion polymerization is accomplished by (i) emulsification and heating of monomer, chain transfer agent, surfactant, and initiator;

(ii) adding a free radical initiator and beating;

(iii) to provide said shell polymer and admixing and heating with a carrier core.

30. A process in accordance with claim 1 wherein said shell polymer is styrene, butadiene, isoprene, or acrylonitrile.

31. A process in accordance with claim 1 wherein said polymer core is methyl methacrylate (MMA)/diisopropylaminoethyl methacrylate (DIAEMA), and said polymer shell is methyl methacrylate (MMA)/diisopropylaminoethyl methacrylate (DIAEMA).

32. A process in accordance with claim 31 wherein said core polymer to said shell polymer weight ratio is about 50:50.

* * * * *